US006528222B2

(12) United States Patent
Kohtaki et al.

(10) Patent No.: US 6,528,222 B2
(45) Date of Patent: Mar. 4, 2003

(54) TONER

(75) Inventors: Takaaki Kohtaki, Mishima (JP); Wakashi Iida, Numazu (JP); Nobuyoshi Sugahara, Shizuoka-ken (JP); Takayuki Itakura, Mishima (JP); Yojiro Hotta, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/900,037

(22) Filed: Jul. 9, 2001

(65) Prior Publication Data

US 2002/0072005 A1 Jun. 13, 2002

(30) Foreign Application Priority Data

Jul. 10, 2000 (JP) ..... 2000-208024
Jul. 10, 2000 (JP) ..... 2000-208028

(51) Int. Cl.[7] ..... G03G 9/00
(52) U.S. Cl. ..... 430/108.21
(58) Field of Search ..... 430/108.21, 108.1, 430/108.2, 126

(56) References Cited

U.S. PATENT DOCUMENTS

| | | | | |
|---|---|---|---|---|
| 4,921,771 A | | 5/1990 | Tomono et al. | 430/110 |
| 5,635,325 A | | 6/1997 | Inaba et al. | 430/106 |
| 5,660,963 A | | 8/1997 | Donjo et al. | 430/107 |
| 6,090,515 A | * | 7/2000 | Tomiyama et al. | 430/106 |
| 6,210,852 B1 | * | 4/2001 | Nakamura | |
| 6,287,740 B2 | * | 9/2001 | Ohmura et al. | 430/108.8 |

FOREIGN PATENT DOCUMENTS

| | | |
|---|---|---|
| JP | 3304 | 1/1977 |
| JP | 3305 | 1/1977 |
| JP | 52574 | 11/1982 |
| JP | 185660 | 7/1989 |
| JP | 185661 | 7/1989 |
| JP | 185662 | 7/1989 |
| JP | 185663 | 7/1989 |
| JP | 238672 | 9/1989 |
| JP | 107467 | 4/1992 |
| JP | 149559 | 5/1992 |
| JP | 301853 | 10/1992 |
| JP | 061238 | 3/1993 |
| JP | 50368 | 2/1996 |
| JP | 314300 | 11/1996 |

* cited by examiner

*Primary Examiner*—John Goodrow
(74) *Attorney, Agent, or Firm*—Fitzpatrick, Cella, Harper & Scinto

(57) ABSTRACT

A toner, particularly a color toner suitable for full-color image formation through a substantially oil-less heat-pressure fixing device, is formed from at least a binder resin, a colorant and a wax. The binder resin comprises a polyester-based resin selected from the group consisting of (a) a polyester resin, (b) a hybrid resin having a polyester unit and a vinyl polymer unit, and (c) a mixture of these resins. The wax is characterized by including a structural unit including an OH group, an amide, or an ester group at a specific position.

57 Claims, 3 Drawing Sheets

TONER

FIELD OF THE INVENTION AND RELATED ART

The present invention relates to a toner used for developing electrostatic images formed in an image forming method, such as electrophotography, electrostatic recording and electrostatic printing.

Full color copying machines proposed in recent years have generally adopted a process wherein four photosensitive members and a belt-form transfer member are used, electrostatic images formed on the photosensitive members are developed with a cyan toner, a magenta toner, a yellow toner and a black toner, respectively, to form respective toner images on the photosensitive members, and the toner images are successively transferred onto a transfer(-receiving) material conveyed along a straight path between the photosensitive members and the belt-form transfer member to forma full-color image; or a process wherein a transfer(-receiving) material is wound about the circumference of a transfer member with an electrostatic force or a mechanical force exerted by e.g., a gripper, and a development-transfer cycle is repeated four times to form a full color image on the transfer material.

Toners used in such a full-color copying machine are required to exhibit an improved color reproducibility and cause sufficient color mixing in a heat-pressure fixing to provide a full color image with good transparency as required in overhead projector (OHP) images.

Compared with an ordinary black toner for monochromatic copying machines, a toner for full-color image formation may preferably comprise a relatively low-molecular weight binder resin exhibiting a sharp-melting characteristic. However, a toner comprising such a sharp-melting binder resin is liable to cause a problem of high-temperature offset because of low self-cohesion of the binder resin at the time of toner melting in the heat-pressure fixing step.

For an ordinary black toner for monochromatic copying machine, a relatively high-crystalline wax as represented by polyethylene wax or polypropylene wax has been used as a release agent in order to improve the anti-high-temperature offset characteristic at the time of fixation, as proposed in Japanese Patent Publication (JP-B) 52-3304, JP-B 52-3305 and JP-B 57-52574. When such a high-crystallinity wax is used in a toner for full-color image formation, however, the fixed toner image is liable to have inferior transparency, thus providing a projected image with lower saturation and brightness when projected as an OHP image, because of the high crystallinity and difference in refractive index from an OHP sheet material of the wax.

In order to solve the above problem, the use of a nucleating agent together with a wax for lowering the wax crystallinity has been proposed in Japanese Laid-Open Patent Application (JP-A) 4-149559 and JP-A 4-107467.

The use of waxes having a low crystallinity has been proposed in JP-A 4-301853 and JP-A 5-61238. Montan wax has relatively good transparency and a low-melting point, and the use of montan waxes has been proposed in JP-A 1-185660, JP-A 1-185661, JP-A 1-185662, JP-A 1-185663 and JP-A 1-238672.

However, such waxes cannot fully satisfy all the requirements of transparency for OHP use, and low-temperature fixability and anti-high temperature offset characteristic at the time of heat-pressure fixation. For this reason, it has been generally practiced to minimize or omit such a wax or release agent in an ordinary color toner and apply an oil, such as silicone oil or fluorine-containing oil onto a heat-fixing roller so as to improve the anti-high temperature offset characteristic and the transparency for OHP use.

However, according to the measure, the resultant fixed image is liable to have excessive oil on its surface, and the oil is liable to soil the photosensitive member by attachment and swell the fixing roller to shorten the life of the roller. Further, the oil has to be supplied to the fixing roller surface uniformly and at a controlled rate in order to prevent the occurrence of oil lines on the fixed image, and thus tends to require an increase in overall size of the fixing apparatus.

Accordingly, there is a strong desire for a toner which can effectively suppress the occurrence of offset when used in a heat-pressure fixing means omitting or minimizing the use of such an oil for preventing high-temperature offset, and can also provide fixed images with an excellent transparency.

JP-A 8-314300 and JP-A 8-50368 have proposed a toner comprising toner particles enclosing a wax therein formed through suspension polymerization and an image forming method not requiring the fixing oil application.

The toner can suppress the occurrence of oil lines on the fixed images but has to enclose a large amount of wax in the toner particles. Moreover, a binder principally comprising a styrene-acrylate resin is used. As a result, the resultant fixed images are liable to have surface unevennesses, to result in a lower transparency for the OHP use.

Moreover, recorded image products obtained by using the toner tend to exhibit low gloss. This is advantageous for providing graphic images including both graphic images and character images not lacking harmony therebetween but is liable to result in pictorial images with narrow reproduced color ranges because of lower secondary color mixability due to insufficient toner melting in the fixing step.

Accordingly, there is a strong desire for a toner which can exhibit excellent secondary color mixability and transparency for OHP use, a broad color reproducibility range and a broad non-offset temperature range, even when processed by a heat-pressure fixing means omitting or minimizing the use of a fixing oil.

SUMMARY OF THE INVENTION

A generic object of the present invention is to provide a toner having solved the above-mentioned problems of the prior art.

A more specific object of the present invention is to provide a toner which can be fixed without applying a large amount of oil or by omitting the oil application at all.

Another object of the present invention is to provide a color toner which can exhibit good transparency for OHP use and a broad color reproducibility range because of good secondary color mixability.

Another object of the present invention is to provide a toner showing good flowability and developing performance.

Another object of the present invention is to provide a toner showing excellent low-temperature fixability and anti-high-temperature offset characteristic, thus showing a broad non-offset temperature range.

Another object of the present invention is to provide a toner showing excellent storability under standing in a high-temperature environment.

A further object of the present invention is to provide an image forming method for forming full-color images by using a toner as mentioned above.

According to the present invention, there is provided a toner, comprising; at least a binder resin, a colorant and a wax, wherein the binder resin comprises a resin selected from the group consisting of (a) a polyester resin, (b) a hybrid resin having a polyester unit and a vinyl polymer unit, and (c) a mixture of these resins, and the wax has a structural unit including a polar group and represented by any one of formulae (I)–(IV) or a structure having a polar group and represented by formula (V):

(I)

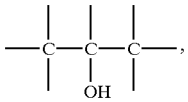

(II)

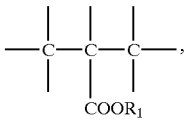

wherein $R_1$ denotes hydrogen or a hydrocarbon group having 1–8 carbon atoms, (III)

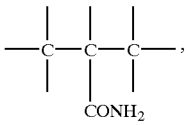

(IV)

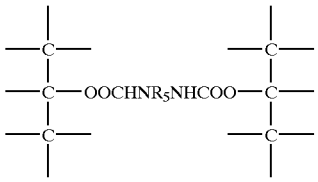

wherein $R_5$ denotes a saturated hydrocarbon group having 2–20 carbon atoms, an unsaturated hydrocarbon group having 2–10 carbon atoms, an aromatic hydrocarbon group, or an alicyclic hydrocarbon group, and (V)

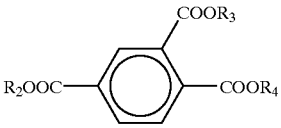

wherein $R_2$, $R_3$ and $R_4$ independently denote hydrogen or a hydrocarbon group having 8–50 carbon atoms with the proviso that at least one of $R_2$, $R_3$ and $R_4$ is a hydrocarbon group having 8–50 carbon atoms.

According to the present invention, there is further provided an image forming method, comprising:

(A) an image forming cycle including:

a step of forming an electrostatic image on an image bearing member, a step of developing the electrostatic image with a color toner to form a color toner image on the image bearing member, and a step of transferring the color toner image onto a transfer material via or without via an intermediate transfer member, (B) a process of repeating the image forming cycle (A) four times by using first to fourth color toners, respectively, to form superposed first to fourth color toner images on the transfer material, and (C) a step of fixing the superposed first to fourth color toner images on the transfer material under application of heat and pressure to form a fixed full-color image on the transfer material, wherein the first to fourth color color toners are selected successively in an arbitrary order from the group consisting of a cyan toner, a magenta toner, a yellow toner and a black toner, each of the cyan, magenta, yellow and black toners comprises at least a binder resin, a wax and a corresponding colorant selected from the group consisting of a cyan colorant, a magenta colorant, a yellow colorant and a black colorant, the binder resin comprises a resin selected from the group consisting of (a) a polyester resin, (b) a hybrid resin having a polyester unit and a vinyl polymer unit, and (c) a mixture of these resins, and the wax has a structural unit including a polar group and represented by any one of formulae (I)–(IV) or a structure having a polar group and represented by formula (V):

(I)

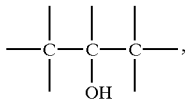

(II)

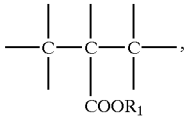

wherein $R_1$ denotes hydrogen or a hydrocarbon group having 1–8 carbon atoms, (III)

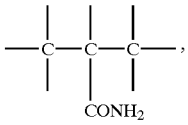

(IV)

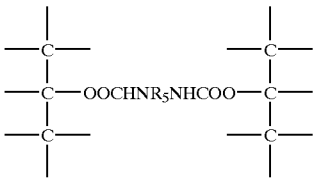

wherein $R_5$ denotes a saturated hydrocarbon group having 2–20 carbon atoms, an unsaturated hydrocarbon group having 2–10 carbon atoms, an aromatic hydrocarbon group, or an alicyclic hydrocarbon group, and (V)

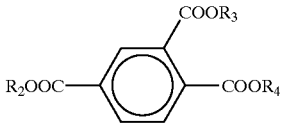

wherein $R_2$, $R_3$ and $R_4$ independently denote hydrogen or a hydrocarbon group having 8–50 carbon atoms with the proviso that at least one of $R_2$, $R_3$ and $R_4$ is a hydrocarbon group having 8–50 carbon atoms.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
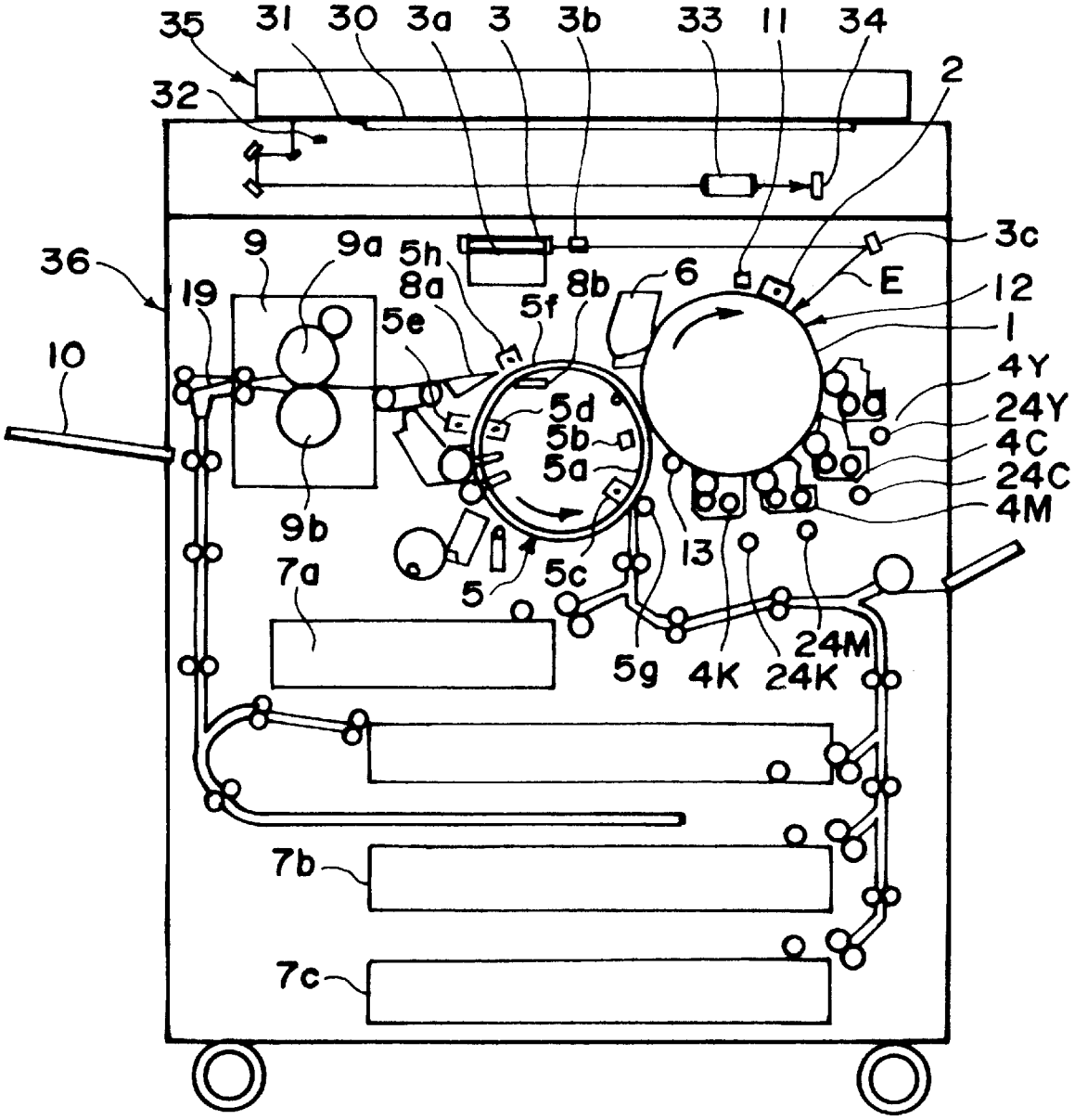
FIG. 1 is a schematic sectional view of an example of full-color image forming apparatus suitable for using the toner of the present invention.

The toner of the present invention is suitable for use in a heat-pressure fixing means using no or only a minimum amount of fixing oil (or offset prevention oil), and can still exhibit a broad color reproducibility range due to high gloss reproducibility and good secondary color mixability, and also a broad non-offset temperature range, as a result of an optimum combination of a specific resin (composition) and a specific wax. Further, the toner of the present invention exhibits a good developing performance due to good flowability of toner particles constituting it, and also good heat resistance and excellent transparency for the OHP use.

Hereinbelow, the organization of the toner will be described more specifically.

The polyester resin as a preferred species of the binder resin constituting the toner of the present invention may be formed from an alcohol, and a carboxylic acid, a carboxylic acid anhydride or a carboxylic acid ester, as starting monomers. More specifically, examples of dihydric alcohol may include: bisphenol A alkylene oxide adducts, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane; ethylene glycol, diethylene glycol, triethylene glycol, 1,2-propylene glycol, 1,4-butanediol, neopentyl glycol, 1,4-butene-diol, 1,5-pentane-diol, 1,6-hexane-diol, 1,4-cyclohexane-dimethanol, dipropylene glycol, polyethylene glycol, poly propylene glycol, polytetramethylene glycol, bisphenol A and hydrogenated bisphenol A.

Examples of alcohols having three or more hydroxy groups may include: sorbitol, 1,2,3,6-hexane-tetrol, 1,4-sorbitan, pentaerythritol, dipenta-erythritol, tripentaerythritol, 1,2,4-butanetriol, 1,2,5-pentanetriol, glycerol, 2-methylpropanetriol, trimethylolethane, trimethylol propane, and 1,3,5-trihydroxymethylbenzene.

Examples of the acid may include: aromatic dicarboxylic acids, such as phthalic acid, isophthalic acid and terephthalic acid, and anhydrides thereof; alkyldicarboxylic acids, such as succinic acid, adipic acid, sebacic acid and azelaic acid, and anhydrides thereof; alkyl-substituted succinic acids substituted with an alkyl group having 6–12 carbon atoms, and anhydrides thereof; and unsaturated dicarboxylic acids, such as fumaric acid, maleic acid and citraconic acid, and anhydrides thereof.

Among polyester resins formed by reaction between the above-mentioned diols and acids, those formed as polycondensates between a bisphenol derivative represented by formula (1) shown below, and a carboxylic acid selected from carboxylic acids having two or more barboxyl groups, anhydrides thereof or lower alkyl ester thereof (e.g., fumaric acid, maleic acid, maleic anhydride, phthalic ac id, terephthalic acid, trimellitic acid, and pyromellitic acid), are preferred so as to provide a color toner having a good chargeability:

(1)

(1)

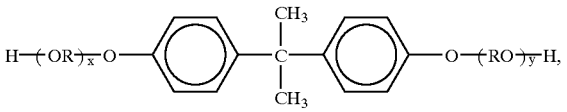

wherein R denotes an ethylene or propylene group, x and y are independently a positive integer of at least 1 with the proviso that the average of x+y is in the range of 2–10.

The hybrid resin used as another preferred species of the binder resin constituting the toner of the present invention means a resin comprising a vinyl copolymer unit and a polyester unit chemically bonded to each other. More specifically, such a hybrid resin may be formed by reacting a polyester unit with a vinyl polymer unit obtained by polymerization of a monomer having a carboxylate ester group such as a (meth)acrylate ester or with a vinyl polymer unit obtained by polymerization of a monomer having a carboxyl group such as (meth)acrylic acid through transesterification or polycondensation. Such a hybrid resin may preferably assume a form of a graft copolymer (or a block copolymer) comprising the polyester unit as a trunk polymer and the vinyl polymer unit as the branch polymer.

Examples of a vinyl monomer to be used for providing the vinyl polymer unit of the hybrid resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethyl-styrene, p-n-butylstyrene, p-tert-butylstyrene, p-n-hexylstyrene, p-n-octylstyrene, p-n-nonylstyrene, p-n-decylstyrene, p-n-dodecylstyrene, m-nitrostyrene, o-nitrostyrene, and p-nitrostyrene; ethylenically unsaturated monoolefins, such as ethylene, propylene, butylene, and isobutylene; unsaturated polylenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate;

acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinyl-carbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the below-mentioned α,β-unsaturated acids and diesters of the below-mentioned dibasic acids.

Examples of carboxy group-containing vinyl monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

It is also possible to use a hydroxyl group-containing vinyl monomer: inclusive of acrylic or methacrylic acid esters, such as 2-hydroxyethyl acrylate, 2-hydroxyethyl methacrylate and 2-hydroxypropyl methacrylate; 4-(1-hydroxy-1-methylbutyl)styrene, and 4-(1-hydroxy-1-methylhexyl)-styrene.

In the binder resin according to the present invention, the vinyl polymer unit can include a crosslinking structure obtained by using a crosslinking monomer having two or more vinyl groups, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)-propanediacrylate, and compounds obtained by substituting methacrylate groups for the acrylate groups in the above compounds.

Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

In the present invention, it is preferred that the vinyl polymer component and/or the polyester resin component contain a monomer component reactive with these resin components. Examples of such a monomer component constituting the polyester resin and reactive with the vinyl resin may include: unsaturated dicarboxylic acids, such as phthalic acid, maleic acid, citraconic acid and itaconic acid, and anhydrides thereof. Examples of such a monomer component constituting the vinyl polymer and reactive with the polyester resin may include: carboxyl group-containing or hydroxyl group-containing monomers, and (meth)acrylate esters.

In order to adjust the molecular weight distribution of the vinyl polymer, it is preferred to use a molecular weight-adjusting agent, examples of which may include: mercaptans represented by a formula of RSH (R: alkyl group), such as t-dodecylmercaptan, and α-methylstyrene, α-methylstyrene dimer, and α-methylstyrene oligomers.

In order to obtain a binder resin mixture containing a reaction product between the vinyl resin and polyester resin, it is preferred to effect a polymerization reaction for providing one or both of the vinyl resin and the polyester resin in the presence of a polymer formed from a monomer mixture including a monomer component reactive with the vinyl resin and the polyester resin as described above.

Examples of polymerization initiators for providing the vinyl polymer unit according to the present invention may include: 2,2'-azobisisobutyro-nitrile, 2,2'-azobis(4-methoxy-2,4-dimethylvalero-nitrile), 2,2'-azobis(2,4-dimethylvaleronitrile), 2,2 '-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides, such as methyl ethyl ketone peroxide, acetylacetone peroxide, and cyclohexanone peroxide; 2,2-bis(t-butylperoxy)-butane, t-butylhydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydi-carbonate, di(3-methyl-3-methoxybutyl) peroxy-carbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyiso-phthalate, t-butyl peroxyallylcarbonate, t-amyl peroxy-2-ethylhexanoate, di-t-butyl peroxyhexahydro-terephthalate, and di-t-butyl peroxyazelate.

The binder resin for constituting the toner according to the present invention may for example be produced according to the following methods (1)–(6):

(1) The vinyl resin, the polyester resin and the hybrid resin are separately formed and then blended. The blending may be performed by dissolving or swelling the resins in an organic solvent, such as xylene, followed by distilling-off of the organic solvent. The hybrid resin may be produced as a copolymer by dissolving or swelling a vinyl resin and a polyester resin prepared separately in advance in a small amount of an organic solvent, followed by addition of an esterification catalyst and an alcohol and heating to effect transesterification.

(2) A vinyl resin is first produced, and in the presence thereof, a polyester resin and hybrid resin component are produced. The hybrid resin component may be produced through a reaction of the vinyl resin (and a vinyl monomer optionally added) with polyester monomers (such as an alcohol and a carboxylic acid) and/or a polyester. Also in this case, an organic solvent may be used as desired.

(3) A polyester resin is first produced, and in the presence thereof, a vinyl resin and a hybrid resin component are produced. The hybrid resin component may be produced through the reaction of the polyester resin (and polyester monomers optionally added) with vinyl monomers and/or a vinyl resin in the presence of an esterification catalyst.

(4) A vinyl resin and a polyester resin are first produced, and in the presence of these resins, vinyl monomers and/or polyester monomers (alcohol and hA carboxylic acid) are added thereto for polymerization and transesterification. Also this instance, an organic solvent may be used as desired.

(5) A hybrid resin is first prepared, and then vinyl monomers and/or polyester monomers are added to effect addition polymerization and/or poly-condensation. In this instance, the hybrid resin may be one prepared in the methods of (2)–(4), or may be one produced through a known process. An organic solvent may be added as desired.

(6) Vinyl monomers and polyester monomers (alcohol and carboxylic acid) are mixed to effect addition polymerization and polycondensation successively to provide a vinyl resin, a polyester resin and a hybrid resin component. An organic solvent may be added as desired.

In the above methods (1)–(5), the vinyl resin and/or the polyester resin may respectively comprise a plurality of polymers having different molecular weights and crosslinking degrees.

In the hybrid resin for constituting the binder resin of the toner according to the present invention, the vinyl polymer unit and the polyester unit may preferably be contained in a weight ratio (vinyl polymer unit/polyester unit) of at most 1.0, more preferably at most 0.5. In other words, the vinyl polymer unit and the polyester unit may preferably be used in a weight ratio of 0.5:99.5–50:50.

If the vinyl polymer unit content exceeds 50 wt. % in the hybrid resin, the glass transition temperature (Tg) of the binder resin is liable to be lowered by the influence of the vinyl polymer unit generally constituting a branch polymer unit, thus lowering the storability of the resultant toner.

On the other hand, if the vinyl polymer unit component in the hybrid resin is below 0.5 wt. %, the powder blending of the wax and optionally the vinyl resin with the polyester resin as a principal binder resin is liable to become difficult, so that a preliminary melt-blending or a blending together with solvent at an elevated temperature becomes necessary.

The binder resin for constituting the toner of the present invention can assume a form of a mixture of a polyester resin and a hybrid resin; a mixture of a polyester resin and a vinyl copolymer; or a mixture of a hybrid resin and a vinyl copolymer.

Now, the wax used for constituting the toner of the present invention will be described more specifically.

The wax having a structural unit of the formula (I) may be obtained by providing an aliphatic hydrocarbon wax, such as paraffin wax, with a hydroxy group (conversion into an alcohol).

More specifically, the wax having a structural unit of the formula (I) may be synthesized by subjecting an aliphatic hydrocarbon wax (such as paraffin wax) having averagely 20–60 carbon atoms to liquid phase oxidation with a molecular oxygen-containing gas in the presence of an acid catalyst, such as boric acid, boric anhydride or metaboric acid. After completion of the liquid phase oxidation, the solid catalyst component, such as boric acid, boric anhydride and metaboric acid, does not remain in the reaction system, but the resultant alcohol forms a boric acid ester which is dissolved in the liquid. The acid catalyst may preferably be used in a proportion of 0.01–1 mol, particularly 0.3–0.5 mol, per 1 mol of the starting aliphatic hydrocarbon wax.

The oxygen-containing gas blown into the reaction system may comprise oxygen, air or a dilution of these with an inert gas. The oxygen content may preferably be 3–20%, particularly 5–10% for providing a wax having a hydroxyl group and an excellent whiteness. The reaction temperature may be 150–250° C., preferably 170–200° C. The starting aliphatic hydrocarbon wax may preferably be paraffin wax.

The wax having a structural unit (1) may preferably have a hydroxyl value of 5–80 mgKOH/g, more preferably 10–70 mgKOH/g.

If the hydroxyl value is below 5 mgKOH/g, the wax may function as a substantially non-polar wax close to paraffin wax, thus exhibiting low mutual solubility or dispersibility with the polyester resin as a principal binder component, so that the resultant toner is liable to result in image defects due to isolation of the wax.

On the other hand, if the hydroxyl value exceeds 80 mgKOH/g, the wax is caused to have too strong a polarity on the contrary, thus also exhibiting low mutual solubility or dispersibility, so that the resultant toner is also liable to result in image defects due to isolation of the wax.

In the alcohol conversion process, the produced alcohol is successively oxidized to be partially converted into polymethylene molecules having a carboxyl group (fatty acids).

Accordingly, it is further preferred that the wax has both a structural unit represented by the formula (I) and a structural unit represented by the formula (II). In this case, the wax may preferably have a hydroxyl value of 5–80 mgKOH/g, more preferably 10–70 mgKOH/g, and an acid value of 1–20 mgKOH/g, more preferably 2–15 mgKOH/g.

An acid value is a value affecting the heat resistance, and if the acid value is below 1 mgKOH/g, the wax is liable to show a lower mutual solubility or dispersibility with the polyester resin as a principal constituent of the binder resin, thus being liable to cause image defects due to isolation of the wax, similarly as in the case of the hydroxyl value being below 5 mgKOH/g.

On the other hand, if the acid value exceeds 20 mgKOH/g, the wax is liable to be softened, thus providing a toner with a lower anti-heat blocking characteristic.

The wax may preferably exhibit thermal characteristic as represented by a heat-absorption curve according to differential scanning calorimetry (DSC) showing a maximum heat absorption peak temperature (Tabs.max) in a range of 55–90° C., more preferably 60–85° C., most preferably 65–80° C., in a temperature range of 30–200° C.

In case of using a wax showing a maximum heat-absorption peak temperature below 55° C., the resultant toner is caused to have a remarkably low glass transition temperature and the wax is liable to be melted at the toner particle surfaces at the time of standing in a high temperature environment, thus providing a toner showing a lower anti-blocking property.

On the other hand, if the maximum heat-absorption peak temperature is above 90° C., the wax cannot be quickly melted to migrate to the fixed image surface at the time of toner image fixation thus being liable to cause high-temperature offset due to a lower releasability.

On the other hand, the wax may preferably exhibit a DSC maximum heat-evolution peak temperature (Tevo.max) in a range of 45–90° C., more preferably 50–85° C. If the maximum heat-evolution peak temperature is below 45° C., the resultant toner is caused to have a remarkably low glass transition temperature and the wax is liable to be melted at the toner particle surfaces at the time of standing in a high temperature environment, thus providing a toner showing a lower anti-blocking property.

If the maximum heat-evolution peak temperature is above 90° C., the wax cannot be quickly melted to migrate to the fixed image surface at the time of toner image fixation thus being liable to cause high-temperature offset due to a lower releasability.

In the course of temperature increase in DSC of a toner, a heat-absorption peak accompanying the transition and melting of the wax is observed, and in the course of temperature decrease, a heat-evolution peak accompanying the solidification, crystallization and transition of the wax is observed. The maximum heat-evolution peak on temperature decrease is a heat-evolution peak accompanying the solidification and crystallization of the wax. The presence of a heat absorption peak accompanying the melting of a wax at a temperature close to the maximum heat-evolution peak temperature of the wax means that the wax is homogeneous with respect to its molecular structure and molecular weight distribution, and the difference is preferably at most 6° C. Thus, by decreasing the temperature difference, the wax is made sharp-melting (i.e., is hard at low temperature, quickly melts and causes a large melt viscosity lowering at the time of melting), and the resultant toner may be provided with good balance among developing performance, anti-blocking characteristic, fixability and anti-offset characteristic.

The wax having the structural unit of the formula (II) may be formed by subjecting an aliphatic hydrocarbon wax to alcohol conversion similarly as in the production of the wax having a structure unit of the formula (I), followed by further oxidation.

The wax having the structural unit of the formul a (II) may preferably have an acid value of 1–60 mgKOH/g, further preferably 2–45 mgKOH/g.

An acid value is a value affecting the heat resistance, and if the acid value is below 1 mgKOH/g, the wax is liable to show a lower mutual solubility or dispersibility with the polyester resin as a principal constituent of the binder resin, thus being liable to image defects due to isolation of the wax.

On the other hand, if the acid value exceeds 60 mgKOH/g, the wax is liable to be softened, thus providing a toner with a lower anti-heat blocking characteristic.

The wax having a structural unit of the formula (III) may be synthesized by subjecting to the wax having a structural unit of the formula (II) formed above to conversion into an ammonium salt and dehydration, or ammonolysis.

The wax having a structural unit of the formula (IV) may be synthesized by subjecting the wax having a structural unit of the formula (I) to further coupling of the OH groups with a diisocyanate.

Examples of the diisocyanate may include: aliphatic diisocyanates, such as hexamethylene diisocyanate; aromatic diisocyanates, such as 2,4-toluenediisocyanate, 2,6-toluenediisocyanate, 1,5-naphthalenediisocyanate, p-phenylenediisocyanate, m-phenylenediisocyanate, and diisocyanates of formulae (a) and (b) shown below:

(a)

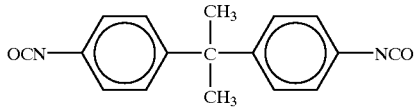

(b)

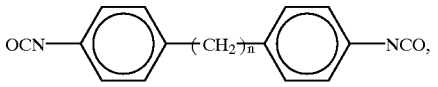

wherein n denotes an integer of 1–8; and alicyclic diisocyanates, such as a diisocyanate of formula (c) shown below:

(c)

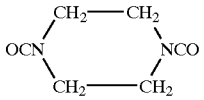

The wax having a structure of the formula (V) may be synthesized by reacting trimellitic acid, trimellitic anhydride or a lower alkyl ester thereof with an aliphatic alcohol having at least 8 carbon atoms or condensation or transesterification.

In the present invention, it is preferred to use the above-mentioned wax having a specific polar group in combination with a non-polar hydrocarbon wax in order to provide further improved low-temperature fixability, anti-high-temperature offset characteristic and anti-blocking property.

In the case of using a polyester-type resin (in a sense of including a hybrid resin) as a principal binder resin, a fairly good fixing performance may be obtained by adding a non-polar hydrocarbon wax, but the wax shows an inferior dispersibility due to poor mutual solubility with the principal binder resin, thus lowering the developing performance of the resultant toner. A polar wax may be uniformly dispersed in the binder resin but is liable to fail in providing sufficient fixing performances. As a result of our study, however, the co-use of a polar wax having a specific polar group has been found effective to improve the dispersibility of a non-polar hydrocarbon wax which shows a poor dispersibility in the polyester-type resin but exhibits good fixing performances, thus providing a color toner with satisfactory developing and fixing performances.

It has been found that a polar wax has a function of improving the dispersion of not only a colorant but also a charge control agent. This effect is more noticeably attained by the polar wax having a specific structural unit (including a polar group at a side chain position) used in the present invention. This is presumably because a polar wax shows good dispersibility within a polyester based resin, but a polar group at a terminal of a wax main chain is not as effective as a polar group at a side chain position for dispersing the colorant and the charge control agent.

When only the fixability of a color toner is considered, the presence of a certain amount of a wax on the toner surface may be sufficient. From the viewpoint of a developing performance, a polar wax is advantageous because of uniform dispersibility. In the combined wax system using polar and non-polar waxes, a wax having a polar group at side chain positions is more advantageous for toner performances than a wax having a polar group at terminal positions. This is presumably because a plurality of polar groups present on a main chain of the wax is effective for not only uniformly dispersing the wax in the polyester-based resin but only for taking in a portion of the non-polar wax therewith to improve the uniform dispersion of the non-polar wax in the toner particles. Such a non-polar wax taken in the polar wax can exude out to the toner particle surfaces upon receiving a heat for fixation based on its thermal characteristic. As a result, the fixability and the developing performance of a color toner for full-color image formation can be satisfied simultaneously.

The non-polar hydrocarbon wax, usable in the present invention, may include: low-molecular weight polyethylene, low-molecular weight polypropylene, microcrystalline wax, and aliphatic hydrocarbon waxes, such as paraffin wax. Aliphatic hydrocarbon waxes, such as paraffin wax, are particularly preferably used.

The non-polar hydrocarbon wax used in the present invention may preferably exhibit a maximum heat-absorption peak temperature (Tabs.max) in a range of 55–90° C., more preferably 6–85° C., on a DSC heat-absorption curve in a temperature range of 30–200° C.

If Tabs.max is below 55° C., the glass transition temperature (Tg) of the toner is remarkably lowered, and the wax is caused to exude to the toner particle surfaces when allowed to stand in a high temperature environment, thus lowering the anti-blocking performance of the toner.

If Tabs.max exceeds 90° C., the wax cannot migrate to the fixed image surface at the time of fixation, thus being liable to result in a lower releasability leading to high-temperature offset phenomenon.

It is also preferred that the non-polar hydrocarbon wax exhibits a maximum heat evolution peak temperature (Tevo.max) of 45–90° C., more preferably 50–85° C., on a DSC heat evolution curve in a temperature range of 30–200° C.

If Tevo.max is below 45° C., the glass transition temperature (Tg) of the toner is remarkably lowered, and the wax is caused to exude to the toner particle surfaces when allowed to stand in a high temperature environment, thus lowering the anti-blocking performance of the toner.

If Tevo.max exceeds 90° C., the wax cannot migrate to the fixed image surface at the time of fixation, thus being liable to result in a lower releasability leading to high-temperature offset phenomenon.

The polar wax and the non-polar hydrocarbon wax may preferably be used each in an amount of 0.1–10 wt. %, more preferably 0.2–7 wt. %, based on the toner weight.

It is also preferred that the toner particles constituting the toner of the present invention contain an organometallic compound, preferred examples of which may include: metal compounds of aromatic carboxylic acid derivatives selected from aromatic oxycarboxylic acids and aromatic alkoxycarboxylic acids. The metal species may preferably have a valence of at least two. Examples of divalent metals may include: $Mg^{2+}$, $Ca^{2+}$, $Sr^{2+}$, $Pb^{2+}$, $Fe^{2+}$, $Co^{2+}$, $Ni^{2+}$, $Zn^{2+}$and $Cu^{2+}$, of which $Zn^{2+}$, $Ca^{2+}$, $Mg^{2+}$and $Sr^{2+}$are preferred. Examples of metal having a valence of 3 or larger may include: $Al^{3+}$, $Cr^{3+}$, $Fe^{3+}$and $Ni^{3+}$, of which $Al^{3+}$and $Cr^{3+}$are preferred, and $Al^{3+}$is most preferred.

As the organometallic compound used in the present invention, it is particularly preferred to use di-tert-butylsalicylic acid aluminum compound.

An aromatic carboxylic acid metal compound (i.e., a metal compound of an aromatic oxycarboxylic or alkoxycarboxylic acid) may for example be synthesized through a process of dissolving an aromatic oxycarboxylic or alkoxycarboxylic acid in a sodium hydroxide aqueous solution, adding an aqueous solution of a metal having a valence of at least 2 dropwise thereto, and heating under stirring the aqueous mixture, followed by pH adjustment of the aqueous mixture, cooling to room temperature, filtration and washing with water. The synthesis process is not restricted to the above.

The organometallic compound may suitably be used in an amount of 0.1–10 wt. % of the toner for causing little change in initial chargeability of the toner, easily providing a necessary charge for the development and thus obviating image quality deterioration such as fog and a lowering in image density.

If the organometallic compound is below 0.1 wt. % or absent in the toner, the toner charge is liable to be lowered in a continuous image formation, thus being liable to result in lower image density.

If the organometallic compound content exceeds 10 wt. %, the toner is liable to be excessively charged to cause a lowering in image density in a continuous image formation.

It is preferred that the toner contains a tetrahydrofuran (THF)-soluble content showing a main peak molecular weight (Mp) of 6000–8000, and a ratio (Mw/Mn) between a weight-average molecular weight (Mw) and a number-average molecular weight of at least 300, more preferably at least 500.

If Mp is below 5000, the toner may exhibit a good low-temperature fixability but is caused to have a lower hot-offset temperature, thus resulting in a narrower anti-offset temperature range. If Mp exceeds 8000, the toner may have a higher hot-offset temperature and thus a broader non-offset temperature range, but the toner is liable to result in images which exhibit a lower gloss and a lower transmittance for OHP use.

If the ratio Mw/Mn is below 300, the toner is caused to have a smaller amount of high-molecular weight component which is presumably formed as a soft gel formed by crosslinking between the organometallic compound and the resin during hot kneading, thus being liable to cause high-temperature offset.

In case where the toner of the present invention is used as a magnetic toner, the toner particles is caused to contain a magnetic material, which also function as a colorant. Examples of the magnetic material may include: iron oxides, such as magnetite, hematite and ferrite; and other metal-containing iron oxides; metals, such as Fe, Co and Ni, alloys of these metals with metals, such as Al, Co, Cu, Pb, Mg, Ni, Sn, Zn, Sb, Be, Bi, Cd, Ca, Mn, Se, Ti, W and V, and mixtures of these.

More specific examples of magnetic materials may include: triiron tetroxide ($Fe_3O_4$), diiron trioxide ($\gamma$-$Fe_2O_3$), iron zinc oxide ($ZnFe_2O_4$), iron yttrium oxide ($Y_3Fe_5O_{12}$), calcium iron oxide ($CdFe_2O_4$), gadolinium iron oxide ($Gd_3Fe_5O_{12}$), copper iron oxide ($CuFe_2O_4$), iron lead oxide ($PbFe_{12}O_{19}$), iron nickel oxide ($NiFe_2O_4$), iron neodium oxide ($NdFe_2O_3$), barium iron oxide ($BaFe_{12}O_{19}$), iron magnesium oxide ($MgFe_2O_4$), iron manganese oxide ($MnFe_2O_4$), iron lanthanum oxide ($LaFeO_3$), iron (Fe), cobalt (Co), and nickel (Ni). These magnetic materials are used in a fine powdery form. Especially preferred magnetic materials may include: fine powders of triiron tetroxide, magnetic ferrite and $\gamma$-diiron trioxide.

The magnetic material may preferably have an average particle size of 0.1–2 $\mu$m, more preferably 0.1–0.5 $\mu$m, and magnetic properties inclusive of a coercive force of 1.6–12.0 kA/m, a saturation magnetization of 50–200 $Am^2/kg$, and a residual magnetization of 2–20 $Am^2/kg$ when measured by applying a magnetic field of 795.8 kA/m (10 k-oersted).

The magnetic material may preferably be contained in 5–120 wt. parts per 100 wt. parts of the binder resin when used in a magnetic monocomponent-type developer carried under a magnetic constraint force on a developer-carrying member enclosing a magnet.

On the other hand, the magnetic material may preferably be contained in 0.1–5 wt. % of the toner when used in a developer carried under substantially no magnetic constraint force on a developer-carrying member enclosing no magnet.

By controlling the magnetic material content in the above-described range, it is possible to suppress the toner scattering (soiling in the image forming machine) during a continuous image formation.

If the magnetic material content exceeds 5 wt. % in the developer, the toner is liable to damage (abrade) the regulating blade or developer-carrying member surface, thus causing charging failure.

Further, in the case of being used in mixture with magnetic carrier particles to form a two-component-type developer, the toner may preferably contain 0.1–5 wt. % of the magnetic material in some cases.

If the toner contains the magnetic material in the above-described range, the toner receives an increased magnetic constraint force from the developer carrying roller, so that the toner scattering (soiling in the image forming machine) during a continuous image formation can be suppressed.

If the magnetic material content exceeds 5 wt. % of the toner, the toner receives an excessively large magnetic constraint force from the developer-carrying roller, thus being liable to result in a lower image density.

The colorant used in the toner of the present invention may comprise a pigment and/or a dye.

Examples of the dye may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Examples of the pigment may include: Mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Cadmium Red, Permanent Red 4R, Watching Red Ca salt, eosine lake; Brilliant Carmine 3B; Manganese Violet, Fast Violet B, Methyl Violet Lake, Cobalt Blue, Alkali Blue Lake, Victoria Blue Lake, Phthalocyanine Blue, Fast Sky Blue, Indanthrene Blue BC, Pigment Green B, Malachite Green Lake, and Final Yellow Green G.

Examples of colorants for constituting toners for full color image formation may include the following.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments having a phthalocyanine skeleton to which 1–5 phthalimidomethyl groups are added.

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

The colorant may be used in an amount of 1–15 wt. parts, preferably 3–12 wt. parts, more preferably 4–10 wt. parts, per 100 wt. parts of the binder resin.

If the colorant content exceeds 15 wt. parts, the toner is caused to have a lower transparency and makes it difficult to reproduce an intermediate color as represented by a human skin color. Further, as the stability of toner chargeability is lowered, it becomes difficult to obtain an objective charge.

If the colorant content is below 1 wt. part, the colorant is caused to have a lower coloring power, so that it becomes difficult to obtain high quality images having a high image density.

It is preferred that the toner particles are blended with an externally added flowability improver, so as to provide an improved image quality. The flowability improver herein means a material effective for improving the flowability of the toner particles by its addition.

Examples of the flowability improver may include: fine powders of fluorine-containing resins, such as polyvinylidene fluoride and polytetrafluoro-ethylene, silica fine powders, such as the wet process silica fine powder and the dry process silica fine powder; treated silica fine powders obtained by surface-treating such silica fine powders with an agent, such as a silane coupling agent, a titanate coupling agent, or silicone oil; titanium oxide fine powder, alumina fine powder, treated titanium oxide fine powder, and treated alumina fine powder.

The flowability improver may preferably have a specific surface area as measured according to nitrogen adsorption by the BET method ($S_{BET}$) of at least 30 $m^2/g$, preferably at least 50 $m^2/g$. The flowability improver may preferably be added in 0.01–8 wt. parts, more preferably 0.1–4 wt. parts, per 100 wt. parts of the toner particles.

Toner particles may be produced through a process wherein the binder resin, the wax, the colorant, and other optional ingredients, such as an organometallic compound, are sufficiently blended in a blender, such as a Henschel mixer or a ball mill, and melt-kneaded by a hot kneading means, such as a kneader or an extruder, and the melt-kneaded product after solidification by cooling is pulverized and classified to obtain toner particles having a prescribed average particle size.

The toner particles thus-produced may be further blended with a flowability improver as mentioned above by means of a blender, such as a Henschel mixer to obtain a toner wherein the flowability improver fine particles are attached to the toner particle surfaces.

The toner of the present invention may preferably have a weight-average particle size (D4) of 3.0–15.0 $\mu$m, more preferably 4.0–12.0 $\mu$m.

If D4 is below 3.0 $\mu$m, the toner is caused to have a lower chargeability, thus being liable to cause fog or toner scattering in a continual image formation on a large number of sheets.

If D4 exceeds 15.0 $\mu$m, the toner is caused to have a lower reproducibility of halftone images, thus being liable to result in halftone images with a rough appearance.

It is further preferred that the toner of the present invention has a D4 in a range of 4.5–9.0 $\mu$m, so to provide images of a higher quality.

Next, an embodiment of the full-color image forming method using the toner of the present invention will now be described with reference to FIG. 1.

FIG. 1 illustrates an embodiment of image forming apparatus for forming full-color images according to electrophotography. The apparatus may be used as a full-color copying apparatus or a full-color printer.

In the case of a full-color copying apparatus, the apparatus includes a digital color image reader unit 35 at an upper part and a digital color image printer unit 36 at a lower part as shown in FIG. 1.

Referring further to FIG. 1, in the image reader unit, an original 30 is placed on a glass original support 31 and is subjected to scanning exposure with an exposure lamp 32. A reflection light image from the original 30 is concentrated at a full-color sensor 34 to obtain a color separation image signal, which is transmitted to an amplifying circuit (not show) and is transmitted to and treated with a video-treating unit (not shown) to be outputted toward the digital image printer unit.

In the image printer unit, a photosensitive drum 1as an electrostatic image-bearing member may, e.g., include a photosensitive layer comprising an organic photoconductor (OPC) and is supported rotatably in a direction of an arrow. Around the photosensitive drum 1, a pre-exposure lamp 11, a corona charger 2, a laser-exposure optical system (3*a*, 3*b*, 3*c*), a potential sensor 12, four developing devices containing developers different in color (4Y, 4C, 4M, 4B), a luminous energy (amount of light) detection means 13, a transfer device 5, and a cleaning device 6 are disposed.

In the laser exposure optical system 3, the image signal from the image reader unit is converted into a light signal for image scanning exposure at a laser output unit (not shown). The converted laser light (as the light signal) is reflected by a polygonal mirror 3*a* and projected onto the surface of the photosensitive drum via a lens 3*b* and a mirror 3*c*.

In the printer unit, during image formation, the photosensitive drum 1 is rotated in the direction of the arrow and charge-removed by the pre-exposure lamp 11. Thereafter, the photosensitive drum 1 is negatively charged uniformly by the charger 2 and exposed to imagewise light E for each separated color, thus forming an electrostatic latent image on the photosensitive drum 1.

Then, the electrostatic latent image on the photosensitive drum is developed with a prescribed toner by operating the prescribed developing device to form a toner image on the photosensitive drum 1. Each of the developing devices 4Y, 4C, 4M and 4B performs development by the action of each of eccentric cams 24Y, 24C, 24M and 24B so as to selectively approach the photosensitive drum 1 depending on the corresponding separated color.

The transfer device 5 includes a transfer drum 5*a*, a transfer charger 5*b*, an adsorption charger 5*c* for electrostatically adsorbing a transfer material, an adsorption roller 5*g* opposite to the adsorption charge 5*c* an inner charger 5*d*, an outer charger 5*e*, and a separation charger 5*h*. The transfer drum 5*a* is rotatably supported by a shaft and has a peripheral surface including an opening region at which a transfer sheet 5*f* as a transfer material-carrying member for carrying the recording material is integrally adjusted. The transfer sheet 5*f* may include resin film, such as a polycarbonate film.

A transfer material is conveyed from any one of cassettes 7*a*, 7*b* and 7*c* to the transfer drum 5*a* via a transfer material-conveying system, and is held on the transfer drum 5*a*. The transfer material carried on the transfer drum 5*a* is repeatedly conveyed to a transfer position opposite to the photosensitive drum 1 in accordance with the rotation of the transfer drum 5*a*. The toner image on the photosensitive drum 1 is transferred onto the transfer material by the action of the transfer charger 5*b* at the transfer position.

A toner image on the photosensitive member 1 may be directly transferred onto a transfer material as in the embodiment of FIG. 1, or alternatively once transferred onto an intermediate transfer member (not shown) and then to the transfer material.

The above image formation steps are repeated with respect to yellow (Y), magenta (M), cyan (C) and black (B) to form a color image comprising superposed In four color toner images on the transfer material carried on the transfer drum 5.

The transfer material thus subjected to transfer of the toner image (including four color images) is separated from the transfer drum 5 by the action of a separation claw 8*a*, a separation and pressing roller 8*b* and the separation charger 5*h* to be conveyed to heat-pressure fixation device, where the full-color image carried on the transfer material is fixed under heating and pressure to effect color-mixing and color development of the toner and fixation of the toner onto the transfer material to form a full-color fixed image (fixed full-color image), followed by discharge thereof into a tray 10. As described above, a full-color copying operation for one sheet of recording material is completed.

In the full-color image operation, the fixing operation in the heat-pressure fixing device is performed at a process speed (e.g., 90 mm/sec) smaller than a process speed or a developing speed (e.g., 160 mm/sec) on the photosensitive drum 1. Such a smaller fixing speed than the developing speed is adopted so as to supply an ample heat for melt-mixing the superposed two to four-layer superposed yet-unfixed toner layers.

Figure 2:
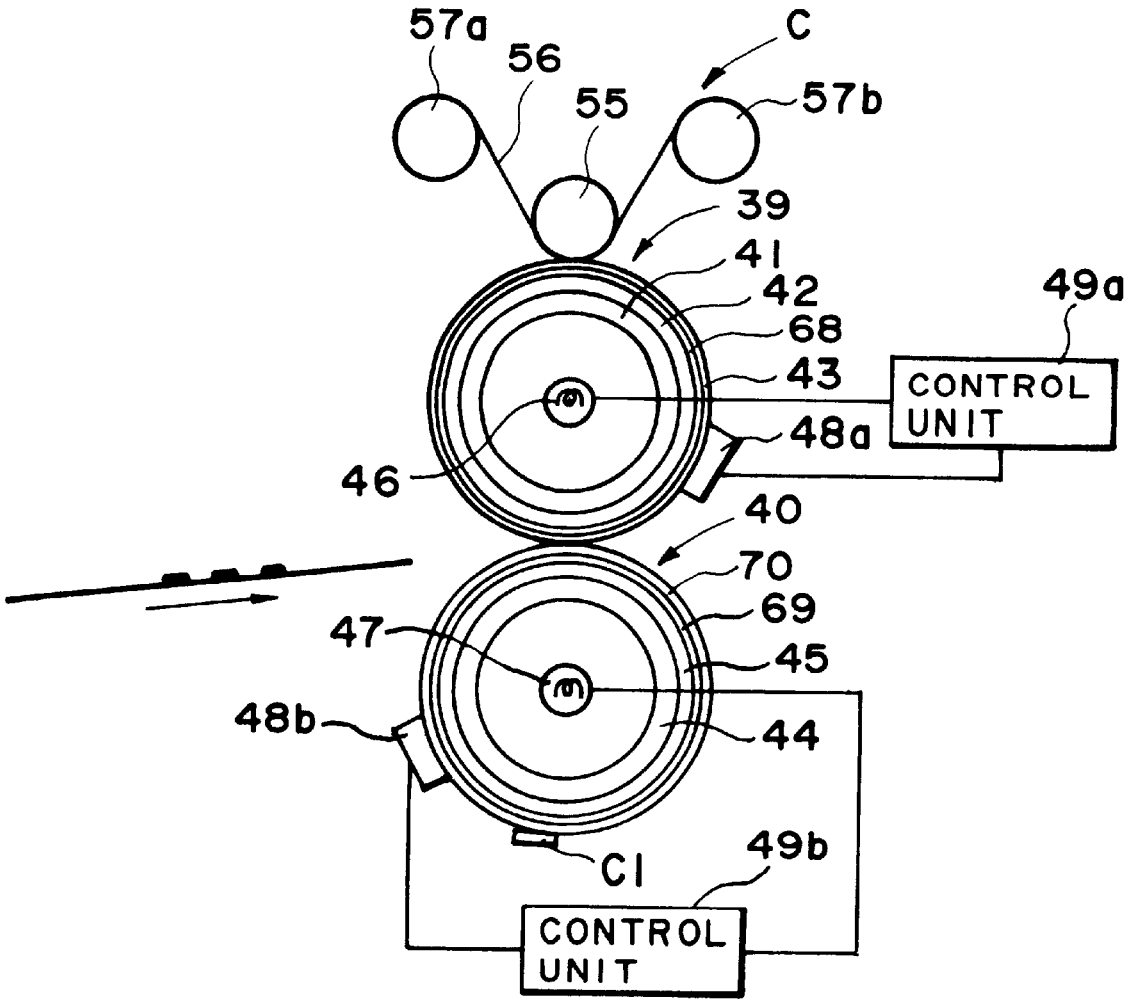
FIG. 2 is a schematic sectional illustration of a heat-pressure fixing means.

FIG. 2 is a schematic sectional view for illustrating an organization of such a heat-pressure fixing device. Referring to FIG. 2, the fixing device includes a fixing roller 39 as a fixing means, which comprises an e.g., 5 mm-thick aluminum metal cylinder 41, and the cylinder 41 is coated with a 3 mm-thick RTV (room temperature-vulcanized) silicone rubber layer 42 (having a JIS-A hardness of 20 deg.) and further with a 50 $\mu$m-thick polytetrafluoroethylene (PTFE) layer 43. On the other hand, a pressure roller 40 as a pressure means comprises an e.g., 5 mm-thick aluminum-made metal cylinder 44, which is coated with a 2 mm-thick RTV silicone rubber layer 55 (JIS-A hardness of 40 deg.) and then with a 150 $\mu$m-thick PTFE layer.

In the embodiment of FIG. 2, the fixing roller 39 and the pressure roller 40 both have a diameter of 60 mm. As the pressure roller 40 has a higher hardness, however, a blank transfer paper carrying no toner image is discharged in a direction which is somewhat deviated toward the pressure roller 40 from a line perpendicular to a line connecting the axes of these two rollers. The deviation of the discharge direction toward the pressure roller side is very important for obviating clinping or winding about the fixing roller of a transfer or recording paper for carrying a large-area copy image to be fixed thereon. The deviation of the paper discharge direction may be effected not only by utilizing the above-mentioned hardness difference but also by using a pressure roller having a smaller diameter than the fixing roller or by using a pressure roller set at a higher temperature than the fixing roller so as to preferentially vaporize the moisture from the back (i.e., the pressure roller side) of the fixing paper, thereby causing a slight paper shrinkage.

The fixing roller 39 is provided with a halogen heater 46 as a heating means, and the pressure roller 40 is also provided with a halogen heater 47, so as to allow heating of a fixing paper from both sides. The temperatures of the fixing roller 39 and the pressure roller 40 are detected by thermistors 48*a* and 48*b* abutted against the fixing and pressure rollers 39 and 40, respectively, and the energization of the halogen heaters 46 and 47 is controlled based on the detected temperatures, whereby the temperatures of the fixing roller 39 and the pressure roller 40 are both controlled at constant temperatures (e.g., 160° C. ±10° C.) by controllers 49*a* and 49*b*, respectively. The fixing roller 39 and the pressure roller 40 are pressed against each other at a total force of 390 N (40 kg.f) by a pressure application mechanism (not shown).

The fixing device also includes a fixing roller cleaning device C equipped with oil-impregnated web, and also a cleaning blade C1 for removing oil and soil attached to the pressure roller 40. A paper or unwoven cloth web 56 is impregnated with a silicone oil having a viscosity of 50–3000 cSt, such as dimethylsilicone oil or diphenylsilicone oil, which is preferred so as to allow a constant oil supply at a small rate and provide high-quality fixed images with uniform gloss and free from oil trace. In the case of no oil application, the cleaning device C may be removed or operated by using a paper or cloth web 56 not impregnated with oil, or may be replaced by a cleaning blade, a cleaning pad or a cleaning roller.

In a specific example, the cleaning device C was equipped with a web 46 of non-woven cloth pressed against the fixing roller 39 while the web 46 was fed little by little from a feed roll 57*a* to a take-up roller 57*b* so as to prevent the accumulation of waste toner, etc.

As the toner of the present invention is excellent in low-temperature fixability and anti-high-temperature offset characteristic, the application amount of the release agent, such as silicone oil, can be reduced and the cleaning device C is less liable to be soiled.

A toner image formed of the toner according to the present invention may suitably be fixed under pressure at a fixing roller surface temperature of 150° C. while applying substantially no oil or silicone oil at a rate of at most $1\times10^{-7}$ g/cm$^2$ of recording material (transfer material) surface area from the fixing member onto the toner image fixing surface of the recording material.

If the application amount exceeds $1\times10^{-7}$ g/cm$^2$, the fixed image on the recording material is liable to glitter, thus lowering the recognizability of character images.

Figure 3:
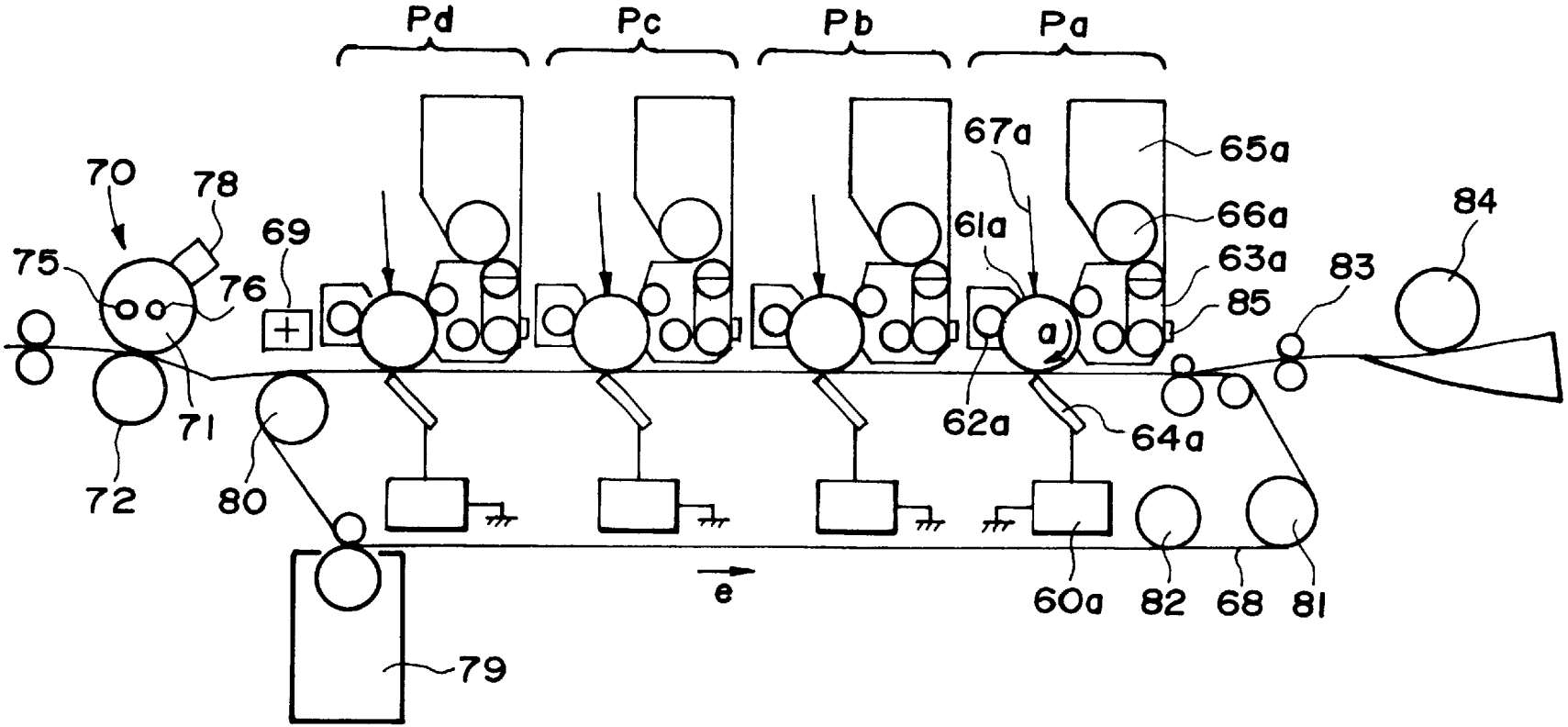
FIG. 3 is a schematic sectional view of another example of full-color image forming apparatus suitable for using the toner of the present invention.

FIG. 3 illustrates a full-color image forming system suitable for practicing another embodiment of the image forming method according to the present invention.

Referring to FIG. 3, a full-color image forming apparatus main body includes a first image forming unit Pa, a second image forming unit Pb, a third image forming unit Pc and a fourth image forming unit Pd disposed in juxtaposition for forming respectively images of difference colors each formed through a process including electrostatic image formation, development and transfer steps on a transfer material.

The organization of the image forming units juxtaposed in the image forming apparatus will now be described with reference to the first image forming unit Pa, for example.

The first image forming unit Pa includes an electrophotographic photosensitive drum 61*a* of 30 mm in diameter as an electrostatic image-bearing member, which rotates in an indicated arrow a direction. A primary charger 62*a* as a charging means includes a 16 mm-dia sleeve on which a magnetic brush is formed so as to contact the surface of the photosensitive drum 61*a*. The photosensitive drum 61*a* uniformly surface-charged by the primary charger 62*a* is illuminated with laser light 67*a* from an exposure means (not shown) to form an electrostatic image on the photosensitive drum 61*a*. A developing device 63*a* containing a color toner is disposed so as to develop the electrostatic image on the photosensitive drum 61*a* to form a color toner image thereon. A transfer blade 64*a* is disposed as a transfer means opposite to the photosensitive drum 61*a* for transferring a color toner image formed on the photosensitive drum 61*a* onto a surface of a transfer material (recording material) conveyed by a belt-form transfer material-carrying member 68, the transfer blade 64*a* is abutted against a back surface of the transfer material carrying member 68 to supply a transfer bias voltage thereto.

In operation of the first image forming unit Pa, the photosensitive drum 61*a* is uniformly primarily surface-charged by the primary charger 62*a* and then exposed to laser light 67*a* to form an electrostatic image thereon, which is then developed by means of the developing device 6*a* to form a color toner image. Then, the toner image on the photosensitive drum 61*a* is moved to a first transfer position where the photosensitive drum 61*a* and a transfer material abut to each other and the toner image is transferred onto the transfer material conveyed by and carried on the belt-form transfer material-carrying member 68 under the action of a transfer bias electric field applied from the transfer blade 64*a* abutted against the back-side of the transfer material-carrying member 68.

When the toner is consumed on continuation of the development to lower the T/C ratio (in the case of a two-component developer) or provide a lower toner level (in the case of a mono-component developer), the lowering is detected by a toner concentration or toner level detection sensor 85 including, e.g., an inductance coil (not shown) for detecting a change in permeability of the developer, whereby an amount of replenishing toner 65*a* is supplied corresponding to the amount of consumed toner.

The image forming apparatus includes the second image forming unit Pb, the third image forming unit Pc and the fourth image forming unit Pd each of which has an identical organization as the above-described first image forming unit Pa but contains a toner of a different color, in juxtaposition with the first image forming unit Pa. For example, the first to fourth units Pa to Pd contain a yellow toner, a magenta toner a cyan toner and a black toner, respectively, and at the transfer position of each image forming unit, the transfer of toner image of each color is sequentially performed onto an identical transfer material while moving the transfer material once for each color toner image transfer and taking a registration of the respective color toner images, whereby superposed color images are formed on the transfer material. After forming superposed toner images of four colors on a transfer material, the transfer material is separated from the transfer material-carrying member 68 by means of a separation charger 69 and sent by a conveyer means like a transfer belt to a fixing device 70 where the superposed color toner images are fixed onto the transfer material in a single fixation step to form an objective full-color image.

The fixing device 70 includes, e.g., a pair of a 40 mm-dia fixing roller 71 and a 30 mm-dia. pressure roller 72. The fixing roller 71 includes internal heating means 75 and 76. Yet unfixed color-toner images on a transfer material are fixed onto the transfer material under the action of heat and pressure while being passed through a pressing position between the fixing roller 71 and the pressure roller 72 of the fixing device 70.

In the apparatus shown in FIG. 3, the transfer material-carrying member 68 is an endless belt member and is moved in the direction of an indicated arrow e direction by a drive roller 80 and a follower roller 81. During the movement, the transfer belt 68 is subjected to operation of a transfer belt cleaning device 79 and a belt discharger. In synchronism with the movement of the transfer belt 68, transfer materials are sent out by a supply roller 84 and moved under the control of a pair of registration roller 83.

By using the image forming systems shown in FIGS. 1 and 3, for example, a color toner image comprising at least a toner according to the present invention is formed on a recording material (i.e., transfer material) sheet in a fixed state to provide a color image.

Various properties of binder resins and toner particles described herein are based values measured according to the following methods.

(1) Hydroxyl Value ($V_{OH}$) and Acid value ($V_A$)

Measured according to JIS K0070 except that in the case where a sample is not readily soluble, a solvent such as dioxane or tetrahydrofuran, is used.

(2) Molecular Weight Distribution by GPC

A sample toner is dissolved in THF and subjected to 6 hours of extraction with THF under refluxing by a Soxhlets extractor to form a GPC sample.

In the GPC apparatus, a column is stabilized in a heat chamber at 40° C., tetrahydrofuran (THF) solvent is caused to flow through the column at that temperature at a rate of 1 ml/min., and 50–200 vl of a GPC sample solution adjusted at a resin concentration of 0.05–0.6 wt. % is injected.

The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $103–2\times10^6$. A preferred example thereof may be a combination of $\mu$-styragel 500, $10^3$, $10^4$ and $10^5$ available from Waters Co.; or a combination of Shodex KA-801, 802, 803, 804, 805, 806 and 807 available from Showa Denko K.K.

(3) Maximum Heat-absorption Peak Temperature (Tabs.max) and Maximum Heat-evolution Peak Temperature (Tevo.max) of a Wax Measurement may be performed in the following manner by using a differential scanning calorimeter ("DSC-7", available from Perkin-Elmer Corp.).

A sample in an amount of 5–20 mg, preferably about 10 mg, is accurately weighed. The sample is placed on an aluminum pan and subjected to measurement in a temperature range of 30–200° C. at a temperature-raising or -lowering rate of 10° C./min in a normal temperature—normal humidity environment in parallel with a blank aluminum pan as a reference.

In the course of temperature increase or decrease, a main absorption or evolution peak appears at a temperature (Tabs.max or Tevo.max) in the range of 30–200° C. on a DSC curve. In the case of plural peaks, the temperature of the largest peak is taken as Tabs.max or Tevo.max.

(4) Particle size distribution

Coulter counter Model TA-II or Coulter Multisizer (available from Coulter Electronics Inc.) may be used as an instrument for measurement. For measurement, a 1%-NaCl aqueous solution as an electrolyte solution is prepared by using a reagent-grade sodium chloride (e.g., "Isoton II" (trade name), available from Coulter Scientific Japan Co. may be commercially available). To 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 $\mu$m by using the above-mentioned apparatus with a 100 micron-aperture to obtain a volume-bias distribution and a number-basis distribution. From the results of the volume-basis distribution, the weight-average particle size (D4) and volume-average particle size (Dv) of the toner may be obtained (while using a central value for each channel as the representative value of the channel).

The following 13 channels are used: 2.00–2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m 10.08–12.70 $\mu$m; 12.70–16.00 $\mu$m; 16.00 20.20 $\mu$m; 10 20.20–25.40 $\mu$m; 25.40–32.00 $\mu$m; 32–40.30 $\mu$m.

(5) Agglomeratability (Dagg.)

Measures as an indication of a flowability of a sample (a toner containing a flowability or toner particles). A larger value of agglomeratability represents a worse flowability.

A powder tester (mfd. by Hosokawa Micron K.K.) is used. On a vibration table of the powder tester, a 200-mesh sieve, a 100-mesh sieve and a 60-mesh sieve are set in a stacked form in this order, and the vibration table is supplied with an input voltage of 21.7 volts and a displacement value of a digital vibration meter is set at 0.130 so as to provide a vibration table vibration width in the range of 60–90 $\mu$m (a rheostat scale of ca. 2.5). Then, 5 g of a sample is placed gently on the uppermost 60-mesh sieve, and the sieves are vibrated for 15 sec. Then, the amounts of the toner on the respective sieves are measured to calculate an agglomeratability (Dagg.) according to the following equation:

Agglomeratability (Dagg) (%)=(toner weight (g) on 60-mesh sieve/5 (g))×100 +(toner weight (g) on 100-mesh sieve/5 (g))×100×3/5 +(toner weight (g) on 200-mesh sieve/5 (g))×100 1/5

A sample is left to stand for ca. 12 hours in an environment of 23° C./60%RH and also subjected to the above-measurement in the environment of 23° C./60 %RH.

Hereinbelow, some specific Examples are raised regarding the production and evaluation of the toner according to the present invention, but these Examples should not be construed to restrict the scope of the present invention.

Production Example for Hybrid Resin (1)

As starting materials for a vinyl copolymer, 2.0 mol of styrene, 0.21 mol of 2-ethylhexyl acrylate, 0.16 mol of fumaric acid, 0.03 mol of α-methylstyrene dimer and 0.06 mol of dicumyl peroxide were placed in a dropping funnel.

Separately, for preparation of a polyester, 7.0 mol of polyoxypropylene(2.2)-2,2-bis(4-hydroxy-phenyl)propane, 3.0 mol of polyoxyethylene(2.2)-2,2-bis(4-hydroxyphenyl) propane, 3.5 mol of terephthalic acid, 1.5 mol of trimellitic anhydride, 5.0 mol of succinic acid and 0.2 g of dibutyltin oxide were placed in a glass-made 4 liter four-necked flask, which was then equipped with a thermometer, a stirring bar, a condenser and a nitrogen-intake pipe, and placed on a mantle heater. Then, the interior of the flask was aerated with nitrogen and then the system was gradually heated under stirring. At 140° C., under continued stirring, the starting materials for the vinyl copolymer including the polymerization initiator in the dropping funnel was added dropwise into the system over 4 hours. Then, the system was heated to 200° C. for 4 hours of reaction to obtain Hybrid resin (1). The results of GPC and Tg (glass transition temperature) measurement for Hybrid resin (1) are shown in Table 1 together with those of the resins obtained in the following Production Examples.

Production Examples for Hybrid Resins (2)–(4)

Hybrid resins (2)–(4) exhibiting properties shown in Table 1 were prepared in the same manner as in the above Production Example except for changing the ratio between the vinyl copolymer unit and the polyester unit as shown in Table 1 and using different compositions of monomers for the vinyl copolymers s follows, i.e., for Hybrid resin (2): 8.0 mol of styrene, 0.84 mol of 1,2-ethylhexyl acrylate, 0.64 mol of fumaric acid and 0.12 mol of a-methylstyrene dimer;

for Hybrid resin (3): 16.3 mol of styrene, 1.50 mol of 1,2-ethylhexyl acrylate, 1.20 mol of fumaric acid and 0.20 mol of a-methylstyrene dimer; and for Hybrid resin (4): 18.0 mol of styrene, 2.0 mol of 1,2-ethylhexyl acrylate, 1.20 mol of fumaric acid and 0.8 of a-methylstyrene dimer. Production Examples for Polyester resins (1)–(3) 3.7 mol of polyoxypropylene (2.2)-2,2-bis(4-hydroxyphenyl)propane, 1.6 mol of polyoxyethylene-(2.2)-2,2-bis(4-hydroxyphenyl) propane, 1.5 mol of terephthalic acid, 1.2 mol of trimellitic anhydride, 2.5 mol of fumaric acid and 0.1 g of dibutyltin oxide were placed in a glass-made 4-liter four-necked flask, which was then equipped with a thermometer, a stirring bar, a condenser and a nitrogen-intake pipe and placed on a mantle heater. In a nitrogen atmosphere, the system was subjected to 5 hours of reaction at 220° C. to obtain Polyester resin (1).

Polyester resins (2) and (3) exhibiting properties shown in Table 1 were prepared in the same manner as the above Production Example except for changing the ratios among the components and the molecular weights while using the same acid species and the same alcohol species.

Production Example for Vinyl copolymer (1)

1000 ml of toluene, and as starting materials for a vinyl copolymer, 2.4 mol of styrene, 0.26 mol of n-butyl acrylate, 0.09 mol of monobutyl maleate, and 0.11 mol of di-t-butyl peroxide, were placed in a 3 liter-four-necked flask, which was then equipped with a thermometer, a stainless steel-made stirring bar, a flow down-type condenser and a nitrogen-intake pipe and placed on a mantle heater. Then, in a nitrogen atmosphere, the system was subjected to reaction at 120° C. under toluene refluxing and stirring to obtain Vinyl copolymer (1).

The properties of the resins obtained in the above Production Examples are inclusively shown in Table 1 below.

TABLE 1

GPC data and Glass transition temp. (Tg) of resins

| Resins | GPC Mw ($\times 10^3$) | GPC Mn ($\times 10^3$) | GPC Mp ($\times 10^3$) | GPC Mw/Mn | Tg (° C.) | Ratio (vinyl unit/ polyester unit) |
|---|---|---|---|---|---|---|
| Hybrid (1) | 35.0 | 4.5 | 7.0 | 7.8 | 64.0 | 0.12 |
| Hybrid (2) | 38.0 | 3.6 | 6.8 | 10.6 | 63.0 | 0.48 |
| Hybrid (3) | 40.0 | 4.1 | 7.3 | 9.8 | 63.0 | 0.96 |
| Hybrid (4) | 42.0 | 4.9 | 8.1 | 8.6 | 60.0 | 1.10 |
| Polyester (1) | 36.0 | 4.0 | 6.9 | 9.0 | 63.0 | — |
| Polyester (2) | 12.0 | 2.9 | 5.8 | 4.1 | 58.5 | — |
| Polyester (3) | 48.0 | 6.1 | 9.1 | 7.9 | 67.0 | — |
| Vinyl (1) | 10.0 | 3.5 | 8.2 | 2.9 | 65.0 | — |

Production Examples (A)–(G) for Polar waxes

Production Production Example (A)

1200 g of paraffin wax having averagely 35 carbon atoms (Cav=35) and a maximum heat-absorption peak temperature (Tabs.max, or melting point (Tmp)) of 69.5° C. was placed in a glass-made cylindrical reaction vessel, and 35.2 g of a catalyst mixture of boric acid and boric anhydride in a mol ratio of 1.5 was added thereto at 140° C. Immediately thereafter, a mixture gas having an oxygen content of ca. 10 mol. % obtained as a mixture of 50 mol. % of air and 50 mol. % of nitrogen was started to be blown into the system at a rate of 20 liter/min. for 2.5 hours of reaction at 180° C. After the reaction, warm water was added to the reaction liquid to effect 2 hours of hydrolysis at 95° C. followed by standing still and recovery of the upper layer reaction product.

The resultant wax exhibited a hydroxyl value ($V_{OH}$) of 35 mgKOH/g, and an acid value ($V_A$) of 5 mgKOH/g, and provided DSC curves exhibiting a maximum heat-absorption peak temperature (Tabs.max) of 67° C. and a maximum heat-evolution peak temperature (Tevo.max) of 63° C. The thus-obtained wax is herein called Polar wax (A).

Polar wax (A) was found to contain an alcohol unit of—$CH_2$—CH(OH)—$CH_2$— and an acid unit —$CH_2$—CH (COOH)—$CH_2$— in a ratio of ca. 7.

Production Example (B)

The reaction in Production Example (A) was repeated, and thereafter 40 g of the catalyst mixture was further added to the reaction system, followed by 6 hours of reaction at 180° C., to recover Polar wax (B). Polar wax (B) exhibited $V_A$=30 mgKOH/g, Tabs.max=66° C. and Tevo.max=62° C.

Production Example (C)

Polar wax (B) prepared above was subjected ammonolysis to obtain Polar wax (C) having a structural unit of the formula (III). Polar wax (C) exhibited Tabs.max=70° C. and Tevo.max=69° C.

Production Example (D)

Polar wax (A) was reacted with diisocyanate of formula [a] below:

[a]

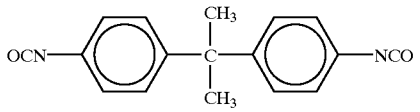

to obtain Polar wax (D) having a structural unit of the formula (IV). Polar wax (D) exhibited Tabs.max=75° C. and Tevo.max=70° C.

Production Example (E)

Trimellitic anhydride and ceryl alcohol [$CH_3$—($CH_2$)—$CH_2OH$] were subjected to condensation to obtain Polar wax (E) having structure of the formula (V). Polar wax (E) exhibited $V_A$=10 mgKOH/g, Tabs.max=68° C. and Tevo.max=63° C.

Production Example (F)

Polar wax (F) having a structural unit of the formula (I) was prepared in the same manner as in Production Example (A) except for using polyethylene wax having averagely 130 carbon atoms (Cav=130) and Tabs.max=141° C. instead of the paraffin wax having averagely 35 carbon atoms (Cav=35). Polar wax (F) exhibited $V_{OH}$=12 mgKOH/g, $V_A$=1 mgKOH/g, Tabs.max=143° C. and Tevo.max=135° C.

Production Example (G)

Polar wax (G) having a structural unit of the formula (I) was prepared in the same manner as in Production Example (A) except for using polyethylene wax having averagely 25 carbon atoms (Cav=25) and Tabs.max=50.5° C. instead of the paraffin wax having averagely 35 carbon atoms (Cav=35). Polar wax (G) exhibited $V_{OH}$=65 mgKOH/g, $V_A$=1 mgKOH/g, Tabs.max=48° C. and Tevo.max=44° C.

EXAMPLE 1

| | |
|---|---|
| Binder resin: Hybrid resin (1) | 100 wt. parts |
| Polar wax: Polar wax (A) | 3 wt. parts |
| Non-polar war: Paraffin wax (1) (Tabs. max = 72° C., Cav = 37) | 3 wt. parts |
| Negative charge control agent: 3,5-di-tert-butyl salicylic acis Al compound | 6 wt. parts |
| Pigment: copper phthalocyanine | 4 wt. parts |

The above ingredients were sufficiently blended by a Henschel mixer and melt-kneaded through a twin-screw extruder. After being cooled, the melt-kneaded product was coarsely crushed to ca. 1–2 mm and then finely pulverized by means of an air-jet pulverizer, followed by classification by means of a multi-division classifier (Elbow Jet classifier) to obtain cyan toner particles having a weight-average particle size (D4) of 7.0 μm as medium-fraction powder (M powder).

M powder and separately recovered fine fraction powder (F powder) were weighed, and the wax contents therein were determined based on DSC measurement to calculate a ratio of the wax content in F powder to the wax content in M powder as a ratio (F/M). A ratio (F/M) close to 1.0 represents a uniform wax dispersion, and a larger ratio (F/M) represents a more non-uniform wax dispersion to results in a toner having a worse chargeability. It is known that a ratio (F/M) of 1.35 or larger results in a toner showing noticeable fog and toner scattering.

100 wt. parts of the cyan toner particles prepared above were blended with externally added 1.0 wt. part of hydrophobic titanium oxide fine powder ($S_{BET}$=110 $m^2/g$) treated with $nC_4H_9Si(OCH_3)_3$ to obtain Cyan toner (1). Some properties and characteristic features of Cyan toner (1) are shown in Table 2 appearing hereinafter together with those of toners prepared in Examples described below.

Cyan toner (1) was further blended with silicone resin-coated magnetic ferrite carrier particles (average particle size (Dav)=50 μm) so as to provide a toner concentration of 7 wt. %,-thereby obtaining Cyan developer (1) of the two-component type.

Cyan developer (1) was incorporated in a color copying machine ("CLC-800" made by Canon K.K.) to form yet-unfixed toner images having an image areal percentage of 25% and a toner coverage of 0.7 mg/cm by a single color-mode image forming operation. The yet-unfixed toner images were subjected to a fixing test by using a fixing apparatus shown in FIG. 2 from which the roller cleaning device C had been removed, at various fixing temperatures and at fixing speeds of 100 mm/sec and 250 mm/sec.

Based on the above fixing tests, the lowest fixable temperature ($T_{FI}$) for a solid image and the high-temperature offset initiation temperature ($T_{OFFSET}$) were determined, and from these temperatures, a fixable or non-offset temperature range ($T_{OFFSET}$–$T_{FI}$) was calculated.

Pressure Roller Soiling-Fixing Paper Back Soiling (Back Soil)

Unfixed toner images on 100 sheets were continuously passed through the fixing device at a fixing temperature of 200° C. in a normal temperature/normal humidity (23.5° C./50%RH) environment. The evaluation was performed based on the number of fixing paper sheets of which the back surfaces were soiled according to the following standard:

A: 0–3 sheets
B: 4–6 sheets
C: 7–9 sheets
D: 10–20 sheets
E: 21 sheets or more.

Curl of Fixing Paper After Fixation (Copy Paper Curl)

A fixing paper sheet (of 84 $g/m^2$) carrying the unfixed toner image (area: 25%, toner: 0.7 $mg/cm^2$) was subjected to fixing at 200° C., and the sheet after the fixation was placed on a flat sheet to measure a maximum edge height due to curling above the flat sheet. The evaluation was performed based on the curl height according to the following standard:

A: below 0.5 cm
B: 0.5–below 1 cm
C: 1.0–below 1.5 cm

-continued

| |
|---|
| D: 1.5–below 3.0 cm |
| E: 3.0 cm or larger. |

OHP Transparency

Toner images were fixed on OHP films at a fixing speed of 30 mm/sec and at a fixing temperature lower by 10° C. than the high-temperature offset initiation temperature ($T_{OFFSET}$), and each fixed toner image on an OHP film was subjected to measurement of a transmittance (%) at a wavelength of 500 nm for a cyan toner, 600 nm for a yellow toner or 650 nm for a magenta toner, as a maximum absorption wavelength of each color, by an automatic recording spectrophotometer ("UV 2200", made by Shimadzu Seisakusho K.K.) relative to the transmittance of the OHP blank film per se (as 100%). Based on the measured relative transmittance (%), the evaluation was performed according to the following standard.

| |
|---|
| A: >85% |
| B: 75–85% |
| C: 65–75% |
| D: 50–65% |
| E: <50%. |

Flowability

Sample toner particles (not blended with an external additive) were stored for 12 hours in an environment of 23° C./60%RH and then subjected to the agglomeratability (Dagg.) measurement described before. Based on the measured Dagg value (%), the evaluation was performed according to the following standard.

| |
|---|
| A: Dagg ≦ 40% |
| B: 41–50% |
| C: 51–60% |
| D: 61–70% |
| E: ≧71%. |

Heat resistance (Anti-blockinQ property)

100 g of a A sample toner (blended with an external additive) was placed in a 500 ml-polyethylene vessel and held in an oven at 50° C. (for 1 week). Based on the degree of agglomeration according to eye observation, the evaluation was performed according to the following standard:

A: No agglomerate was observed at all, and the sample exhibited very good flowability.

B: No agglomerate was observed.

C: Some agglomerate was observed but could be disintegrated easily.

D: Agglomerate was formed but could be disintegrated by a developer stirring device.

E: Agglomerate formed was not sufficiently disintegrated by a developer stirring device.

The results of the above evaluation are inclusively shown in Table 3 together with those of the following Examples are Comparative Examples.

EXAMPLES 2–4

Magenta toner (1), Yellow toner (1) and Black toner (1) were prepared in the same manner as Cyan toner (1) except for using 4 wt. parts of C.I. Pigment Red 122, 7 wt. parts of C.I. Pigment Yellow 180 and 4 wt. parts of carbon black (particle size=20 nm), respectively, instead of the 4 wt. parts of copper phthalocyanine. The characteristics of the respective toners are also shown in Table 2.

Magenta developer (1), Yellow developer (1) and Black developer (1) were prepared and evaluated in the same manner as in Example 1 inclusive of the single color-mode image forming test. The results are also shown in Table 3.

Full-color Test

The four-color developers prepared in Examples 1–4 above were charged in a full-color copying machine ("CLC800", made by Canon K.K.) after remodeling of removing the roller cleaning device C from the fixing device (FIG. 2, similarly as in the model "CP660" also made by Canon K.K.) and subjected to a continuous full-color image forming test on 10,000 sheets.

As a result, full-color copy images showing good color mixing characteristic and broad color reproducibility were produced continually without causing offset.

The thus-formed full color images exhibited good gloss, produced OHP transparencies showing good transmittance when formed on OHP films and exhibited broad non-offset temperature ranges on both plain paper and OHP film.

EXAMPLES 5–9

Cyan toners (2)–(6) and Cyan developers (2)–(6) were prepared and evaluated in the same manner as in Example 1 except for using Polar waxes (B)–(E) instead of Polar wax (A).

EXAMPLES 10–19

Cyan toners (7)–(16) and Cyan developers (7)–(16) were prepared and evaluated in the same manner as in Example 1 except for changing the main binders and/or waxes as shown in Table 2.

COMPARATIVE EXAMPLE 1

Comparative Cyan toner (A) and Comparative cyan developer (A) were prepared and evaluated in the same manner as in Example 1 except for using 100 wt. arts of Polyester resin (1), 6 wt. parts of Paraffin wax (1) and 6 wt. parts of di-tert-butylsalicylic acid Cr compound instead of the corresponding binder, wax and organometallic compound used in Example 1.

As a result, Comparative Cyan toner (A) exhibited a narrower non-offset temperature range and an inferior transparency for OHP use. Comparative Cyan toner (A) also showed noticeable back soiling on fixing paper and copy paper curl and also a lower uniformity of wax dispersion (higher (F/M) ratio of 2.10).

COMPARATIVE EXAMPLES 2–4

Comparative Magenta toner (A), Comparative Yellow toner (A) and Comparative Black toner (A) were prepared in the same manner as in Comparative Example 1 except for using 4 wt. parts of C.I. Pigment Red 122, 7 wt. parts of C.I. Pigment Yellow 180 and 4 wt. parts of carbon black (particle size=20 nm), respectively, instead of the 4 wt. parts of copper phthalocyanine. The characteristics of the respective toners are also shown in Table 2.

Comparative Magenta developer (A), Comparative Yellow developer (A) and Comparative Black developer (A)

were prepared and evaluated in the same manner as in Example 1 inclusive of the single color-mode image forming test. The results are also shown in Table 3.

Full-color test

The four-color developers prepared in Comparative Examples 1–4 above were charged in a full-color copying machine ("CLC800", made by Canon K.K.) after remodeling of removing the roller cleaning device C from the fixing device (FIG. 2, similarly as in the model "CP660" also made by Canon K.K.) and subjected to a continuous full-color image forming test.

As a result, compared with the case of using the developers of Examples 1–4, the comparative developers were liable to cause offset and resulted in fixed full-color images which exhibited low gloss on plain paper and lower transparency on OHP sheets. The non-offset fixable temperature ranges were also narrower.

TABLE 2

| | | | Toner characteristics | | | | | | | | | |
|---|---|---|---|---|---|---|---|---|---|---|---|---|
| | | | Wax | | | | | Organometallic compound | | | | |
| | | | | hydroxyl value | acid value | | | | content | Toner | | |
| | | Main binder Species | Species | [mgKOH/g] | [mgKOH/g] | $T_{abs.max}$ [° C.] | $T_{evo.max}$ [° C.] | metal species | (wt. parts) | Mp | Mw/Mn | (F/M) |
| Example | Toner | | | | | | | | | | | |
| 1 | Cyan (1) | Hybrid (1) | Paraffin (1) | — | — | 72 | 69 | Al | 6.0 | 7500 | 560 | 1.00 |
| | | | Polar (A) | 35 | 5 | 67 | 63 | | | | | |
| 2 | Magenta (1) | Hybrid (1) | Paraffin (1) | — | — | 72 | 69 | Al | 6.0 | 7200 | 550 | 1.02 |
| | | | Polar (A) | 35 | 5 | 67 | 63 | | | | | |
| 3 | Yellow (1) | Hybrid (1) | Paraffin (1) | — | — | 72 | 69 | Al | 6.0 | 7600 | 570 | 1.01 |
| | | | Polar (A) | 35 | 5 | 67 | 63 | | | | | |
| 4 | Black (1) | Hybrid (1) | Paraffin (1) | — | — | 72 | 69 | Al | 6.0 | 7300 | 530 | 1.00 |
| | | | Polar (A) | 35 | 5 | 67 | 63 | | | | | |
| 5 | Cyan (2) | Hybrid (1) | Paraffin (1) | — | — | 72 | 69 | Al | 6.0 | 7450 | 610 | 1.02 |
| | | | Polar (B) | — | 30 | 66 | 62 | | | | | |
| 6 | Cyan (3) | Hybrid (1) | Paraffin (1) | — | — | 72 | 69 | Al | 6.0 | 7200 | 510 | 1.03 |
| | | | Polar (C) | — | — | 70 | 65 | | | | | |
| 7 | Cyan (4) | Hybrid (1) | Paraffin (1) | — | — | 72 | 69 | Al | 6.0 | 7400 | 500 | 1.02 |
| | | | Polar (D) | — | — | 75 | 70 | | | | | |
| 8 | Cyan (5) | Hybrid (1) | Paraffin (1) | — | — | 72 | 69 | Al | 6.0 | 7700 | 520 | 1.03 |
| | | | Polar (E) | — | 10 | 68 | 63 | | | | | |
| 9 | Cyan (6) | Hybrid (1) | Paraffin (1) | — | — | 72 | 69 | Al | 6.0 | 7500 | 620 | 1.04 |
| | | | Polar (A) | 35 | 5 | 67 | 63 | Al | 6.0 | | | |
| | | | Polar (B) | — | 20 | 66 | 62 | | | | | |
| 10 | Cyan (7) | Polyester (1) | Paraffin (1) | — | — | 72 | 69 | Al | 6.0 | 7300 | 570 | 1.02 |
| | | | Polar (A) | 35 | 5 | 67 | 63 | | | | | |
| 11 | Cyan (8) | Hybrid (1): 50 wt. parts | Paraffin (1) | — | — | 72 | 69 | Al | 6.0 | 7500 | 530 | 1.05 |
| | | Polyester (1): 50 wt. parts | Polar (A) | 35 | 5 | 67 | 63 | | | | | |
| 12 | Cyan (9) | Hybrid (1): 50 wt. parts | Paraffin (1) | — | — | 72 | 69 | Al | 6.0 | 7400 | 510 | 1.03 |
| | | Vinyl (1): 50 wt. parts | Polar (A) | 35 | 5 | 67 | 63 | | | | | |
| 13 | Cyan (10) | Hybrid (2) | Paraffin (1) | — | — | 72 | 69 | Al | 5.0 | 7500 | 620 | 1.02 |
| | | | Polar (A) | 35 | 5 | 67 | 63 | | | | | |
| 14 | Cyan (11) | Hybrid (3) | Paraffin (1) | — | — | 72 | 69 | Al | 4.0 | 7000 | 610 | 1.03 |
| | | | Polar (A) | 35 | 5 | 67 | 63 | | | | | |
| 15 | Cyan (12) | Hybrid (4) | Paraffin (1) | — | — | 72 | 69 | Al | 2.0 | 7900 | 550 | 1.04 |
| | | | Polar (A) | 35 | 5 | 67 | 63 | | | | | |
| 16 | Cyan (13) | Hybrid (4) | Paraffin (2) | — | — | 100 | 90 | Al | 1.0 | 7900 | 480 | 1.15 |
| | | | Polar (F) | 12 | 1 | 143 | 135 | | | | | |
| 17 | Cyan (14) | Hybrid (1) | Paraffin (3) | — | — | 53 | 46 | Al | 8.0 | 7700 | 660 | 1.20 |
| | | | Polar (G) | 65 | 1 | 48 | 44 | | | | | |
| 18 | Cyan (15) | Polyester (2) | Paraffin (1) | — | — | 72 | 69 | Al | 9.0 | 6100 | 400 | 1.06 |
| | | | Polar (A) | 35 | 5 | 67 | 63 | | | | | |
| 19 | Cyan (16) | Polyester (3) | Paraffin (1) | — | — | 72 | 69 | Al | 2.0 | 9300 | 330 | 1.10 |
| | | | Polar (A) | 35 | 5 | 67 | 63 | | | | | |
| Comp. Ex. | Comp. Toner | | | | | | | | | | | |
| 1 | Cyan (A) | Polyester (1) | Paraffin (1) | — | — | 72 | 69 | Cr | 6.0 | 7500 | 600 | 2.10 |
| 2 | Magenta (A) | Polyester (1) | Paraffin (1) | — | — | 72 | 69 | Cr | 6.0 | 7500 | 600 | 2.10 |
| 3 | Yellow (A) | Polyester (1) | Paraffin (1) | — | — | 72 | 69 | Cr | 6.0 | 7500 | 600 | 2.10 |
| 4 | Black (A) | Polyester (1) | Paraffin (1) | — | — | 72 | 69 | Cr | 6.0 | 7500 | 600 | 2.10 |

TABLE 3

| | Toner performances | | | | | | | | | | |
|---|---|---|---|---|---|---|---|---|---|---|---|
| | Fixing performances | | | | | | | | Properties | | |
| | Fix. speed = 100 mm/sec | | | Fix. speed = 250 mm/sec | | | | | | | Heat |
| | $T_{FI}$ (° C.) | $T_{OFFSET}$ (° C.) | $T_{OFFSET} - T_{FI}$ (° C.) | $T_{FI}$ (° C.) | $T_{OFFSET}$ (° C.) | $T_{OFFSET} - T_{FI}$ (° C.) | Back soil | Copy paper curl | Flow-ability | Trans-mittance | resistance (50° C., 7 days) |
| Example | | | | | | | | | | | |
| 1 (Cyan (1)) | 100 | 190 | 90 | 150 | 230 | 80 | A | A | A | A | A |
| 2 (Magenta (1)) | 100 | 190 | 90 | 150 | 230 | 80 | A | A | A | A | A |
| 3 (Yellow (1)) | 100 | 190 | 90 | 150 | 230 | 80 | A | A | A | A | A |
| 4 (Black (1)) | 100 | 190 | 90 | 150 | 230 | 80 | A | A | A | — | A |
| 5 | 110 | 190 | 80 | 160 | 230 | 70 | B | A | A | A | A |
| 6 | 110 | 190 | 80 | 160 | 225 | 65 | A | B | A | A | A |
| 7 | 110 | 185 | 75 | 160 | 225 | 65 | B | A | A | B | A |
| 8 | 110 | 180 | 70 | 160 | 220 | 60 | B | B | A | A | A |
| 9 | 100 | 210 | 110 | 140 | 235 | 95 | A | A | A | A | A |
| 10 | 100 | 190 | 90 | 150 | 230 | 80 | B | B | B | A | B |
| 11 | 100 | 185 | 85 | 150 | 220 | 70 | B | A | A | A | A |
| 12 | 110 | 195 | 85 | 150 | 220 | 70 | B | A | A | A | A |
| 13 | 100 | 200 | 100 | 150 | 240 | 90 | A | A | A | A | A |
| 14 | 110 | 210 | 100 | 160 | 250 | 90 | A | A | A | A | B |
| 15 | 120 | 220 | 100 | 170 | 250 | 80 | A | A | A | B | C |
| 16 | 125 | 200 | 75 | 175 | 240 | 65 | B | B | A | A | B |
| 17 | 100 | 175 | 75 | 150 | 215 | 65 | B | B | A | B | B |
| 18 | 100 | 185 | 85 | 150 | 225 | 75 | B | B | A | B | B |
| 19 | 125 | 200 | 75 | 165 | 245 | 80 | A | B | A | C | A |
| Comparative Example | | | | | | | | | | | |
| 1 (Cyan (A)) | 120 | 165 | 45 | 160 | 195 | 35 | E | E | D | D | E |
| 2 (Magenta (A)) | 120 | 165 | 45 | 160 | 195 | 35 | E | E | D | D | E |
| 3 (Yellow (A)) | 120 | 165 | 45 | 160 | 195 | 35 | D | E | D | D | E |
| 4 (Black (A)) | 120 | 165 | 45 | 160 | 195 | 35 | E | E | D | D | E |

Production Example for Hybrid Resin (5)

As starting materials for a vinyl copolymer, 2.0 mol of styrene, 0.21 mol of 2-ethylhesyl acrylate, 0.16 mol of fumaric acid 0.03 mol of α-methylstyrene dimer and 0.05 mol of dituiayl peroxide were placed in a dropping funnel.

Separately for preparation cf a polyester 7.0 mol of polyoxypropyl(2.2)-2,2-bis(4-hydrosy-phenyl)propane, 3.0 mol of polygxyethylane(2.2)-2,2-bis(4-hydroxyphenyl) propane, 3.0 mol of terephthalic acid, 2.0 mol of trimellitic anhydride, 5.0 mol of sucoinic acid and 0.2 g of dihotyltin oxide were placed in a glass-made 4 liter four-necked flask, which was then equipped with a thermometer, a stirring bar, a condenser and a nitrogen-intake pipe, and placed on a mantle heater. Then, the Interior of the flask was aerated with nitrogen and then tire system was gradually heated under stirring. At 140° C. under continued stirring, the starting materials for the vinyl copolymer including the polymerization initiator in the dropping funnel eras added dropwise into the system over 4 hours. Then the system was heated to 200° C. for 4 hours of reaction to obtain Hyhrid resin (5). The results of GPC measurement for Hybrid resin (5) are shown in Table 4 together with those of the resins obtained in the following Production Examples.

Production Example for Polvester Resin (4)

3.5mol of polyaxypropyhene(2.2)-2,2-bis(4-hydroxyphenyl)propane, 1.5 mol of polyoxyethylene-(2.2)-2,2-bis(4-hydroxyphenyl)propane, 1.5 mol of terephthalic acid, 1.0 mol of trimellitic anhydride, 2.5 mol of fumaric acid and 0.1 g of dibutyltin oxide were placed in a glass-made 4-liter four-necked flask, which was then equipped with a thermometer, a stirring bar, a condenser and a nitrogen-intake pipe and placed on a mantle heater. In a nitrogen atmosphere, the system was subjected to 5 hours of reaction at 220° C. to obtain Polyester resin (4).

Production Example for Vinyl Copolymer (2)

1000 ml of toluene, and as starting materials for a vinyl copolymer, 2.4 mol of styrene, 0.26 mol of n-butyl acrylate, 0.09 mol of monobutyl maleate, 0.0001 mol of divinylbenzene and 0.11 mol of di-t-butyl peroxide, were placed in a 3 liter-four-necked flask, which was then equipped with a thermometer, a stainless steel-made stirring bar, a flow down-type condenser and a nitrogen-intake pipe and placed on a mantle heater. Then, in a nitrogen atmosphere, the system was subjected to reaction at 120° C. under toluene refluxing and stirring to obtain Vinyl copolymer (2).

The GPC data of the resins obtained in the above Production Examples are inclusively shown in Table 4 below.

TABLE 4

GPC data for binder resins

| Resins | Mw ($\times 10^3$) | Mn ($\times 10^3$) | Mp ($\times 10^3$) | Mw/Mn |
|---|---|---|---|---|
| Polyester (4) | 23.47 | 3 | 6.1 | 7.82 |
| Hybrid (5) | 82.1 | 2.9 | 14.9 | 28.31 |
| Vinyl (2) | 19.8 | 2.4 | 9.5 | 8.25 |

EXAMPLE 20

| | |
|---|---|
| Binder resin: Hybrid resin (5) | 100 wt. parts |
| Polar wax: Polar wax (A) (OH-modified paraffin wax) | 3 wt. parts |
| Negative charge control agent: di-tert-butyl salicylic acis Al compound | 6 wt. parts |
| Pigment: copper phthalocyanine | 5 wt. parts |

The above ingredients were sufficiently blended by a Henschel mixer and melt-kneaded through a twin-screw extruder. After being cooled, the melt-kneaded product was coarsely crushed to ca. 1–2 mm and then finely pulverized by means of an air-jet pulverizer, followed by classification by mans of a multi-division classifier (Elbow Jet classifier) to obtain cyan toner particles having a weight-average particle size (D4) of 7.0 $\mu$m.

100 wt. parts of the cyan toner particles prepared above were blended with externally added 1.0 wt. part of hydrophobic titanium oxide fine powder ($S_{BET}$=110 $m^2/g$) treated with $nC_4H_9Si(OCH_3)_3$ to obtain Cyan toner 17. Some properties and characteristic features of Cyan toner 17 are shown in Table 5 appearing hereinafter together with those of toners prepared in Examples described below.

Cyan toner 17 was further blended with silicone resin-coated magnetic ferrite carrier particles (average particle size (Dav)=50 $\mu$m) so as to provide a toner concentration of 7 wt. %, thereby obtaining Cyan developer (1) of the two-component type.

Cyan developer (1) was incorporated in a color copying machine ("CLC-800" made by Canon K.K.) to form yet-unfixed toner images having an image areal percentage of 25% and a toner coverage of 0.7 mg/$cm^2$ by a single color-mode image forming operation. The yet-unfixed toner images were subjected to a fixing test by using a fixing apparatus shown in FIG. 2 from which the roller cleaning device C had been removed, at various fixing temperatures and at a fixing speed of 80 mm/sec.

Based on the above fixing tests, the lowest fixable temperature ($T_{FI}$) for a solid image and the high-temperature offset initiation temperature ($T_{OFFSET}$) were determined, and from these temperatures, a fixable or non-offset temperature range ($T_{OFFSET}$–$T_{FI}$) was calculated.

Cyan toner 17 was also evaluated with respect to OHP transparency, Flowability and Heat-resistance (anti-blocking property), similarly as in Example 1.

The results of Evaluation are shown in Table 6 together with those of the following Examples and Comparative Examples.

The fixed toner images obtained in the above test exhibited good gloss and transparency for OHP use, broad non-offset temperature range, and good heat resistance (anti-blocking property).

The properties and the performance evaluation results of the Cyan toner 17 (and Cyan developer 17) are shown in Tables 5 and 6, respectively, together with those obtained in the following Examples and Comparative Examples.

EXAMPLE 21

Cyan toner 18 and Cyan developer 18 were prepared and evaluated in the same manner as in Example 20 except for using Polyester resin (4) instead of Hybrid resin (5).

EXAMPLE 22

Cyan toner 19 and Cyan developer 19 were prepared and evaluated in the same manner as in Example 20 except for replacing the 100 wt. parts of Hybrid resin (5) with a mixture of 55 wt. parts of Polyester resin (4) and 45 wt. parts of Hybrid resin (5).

EXAMPLE 23

Cyan toner 20 and Cyan developer 20 were prepared and evaluated in the same manner as in Example 20 except for replacing the 100 wt. parts of Hybrid resin (5) with a mixture of 85 wt. parts of Polyester resin (4) and 15 wt. parts of Vinyl resin (2).

EXAMPLE 24

Cyan toner 21 and Cyan developer 21 were prepared and evaluated in the same manner as in Example 20 except for replacing the 100 wt. parts of Hybrid resin (5) with a mixture of 95 wt. parts of Hybrid resin (5) and 5 wt. parts of Vinyl resin (2).

EXAMPLE 25

Cyan toner 22 and Cyan developer 22 were prepared and evaluated in the same manner as in Example 20 except for replacing the 100 wt. parts of Hybrid resin (5) with a mixture of 60 wt. parts of Polyester resin (4), 30 wt. parts of Hybrid resin (5), and 10 wt. parts of Vinyl resin (2).

EXAMPLES 26–29

Cyan toners 23–26 and Cyan developers 23–26 were prepared and evaluated in the same manner as in Example 20 except for replacing Polar wax (A) (OH-modified paraffin wax) with Polar waxes (I), (J), (K) and (L) (similarly OH-modified paraffin waxes) having properties shown in Table 5, respectively.

EXAMPLES 30–32

Cyan toners 27 and 28 (and Cyan developers 27 and 28) were prepared and evaluated in the same manner as in Example 20 except for changing the amount of the di-tert-butylsalicylic acid Al compound from 6 wt. parts to 2 wt. parts and 8 wt. parts, respectively.

Further Cyan toner 29 and Cyan developer 29 were prepared and evaluated in the same manner as in Example 20 except for using di-tert-butylsalicylic acid Cr compound instead of the di-tert-butylsalicylic acid Al compound.

EXAMPLE 33

Magenta toner 2 and Magenta developer 2, Yellow toner 2 and Yellow developer 2, and Black toner 2 an Black developer 2, were prepared and evaluated in the same manner as in Example 20 except for using 6 wt. parts of C.I. Pigment Red, 4 wt. parts of C.I. Pigment Yellow and 3 wt. parts of carbon black, respectively, instead of the 6 wt. parts of copper phthalocyanine.

Full-color test

Cyan developer 17 of Example 20, and Magenta developer 2, Yellow developer 2 and Black developer 2 were charged in a full-color copying machine ("CLC800", made by Canon K.K.) after remodeling of removing the roller cleaning device C from the fixing device and subjected to a continuous full-color image forming test in an environment of NT/NH (23° C./60 %RH).

The thus-formed full color images exhibited good gloss, produced OHP transparency showing good transmittance when formed on OHP films and exhibited broad non-offset temperature ranges on both plain paper and OHP film.

COMPARATIVE EXAMPLE 5

Comparative Cyan toner (B) and Comparative Cyan developer (B) were prepared and evaluated in the same manner as in Example 20 except for using Vinyl resin (2) instead of Hybrid resin (5) and using Polar wax (F) (OH-modified paraffin wax) having properties shown in Table 5 instead of Polar wax (A).

The toner exhibited a narrower non-offset temperature range and a worse transparency for OHP use presumably due to the use of a vinyl resin, and also exhibited a lower Tabs.max and a worse heat resistance presumably due to the use of a wax having a larger $V_{OH}$ and also by-produced acid groups.

COMPARATIVE EXAMPLE 6

Comparative Cyan toner (C) and Comparative Cyan developer (C) were prepared and evaluated in the same manner as in Comparative Example 5 except for using Polar wax (G) (OH-modified paraffin wax) having properties shown in Table 5 instead of Polar wax (F).

The toner exhibited a lower flowability to result in lower image quality presumably because of the use of Polar wax (G) having a small $V_{OH}$ and thus showing a behavior similar to non-modified paraffin wax.

COMPARATIVE EXAMPLE 7

Comparative Cyan toner (D) and Comparative Cyan developer (D) were prepared and evaluated in the same manner as in Comparative Example 5 except for using Polar wax (H) (OH-modified paraffin wax) having properties shown in Table 5 instead of Polar wax (F) (OH-modified paraffin wax).

The wax exhibited a lower Tabs.max to result in a toner showing anti-blocking property due to the use of Polar wax (H) having a very large $V_{OH}$ (high degree of OH modification).

COMPARATIVE EXAMPLE 8

Comparative Cyan toner (E) and Comparative Cyan developer (E) were prepared and evaluated in the same manner as in Comparative Example 7 except for using polypropylene wax having properties shown in Table 5 instead of Polar wax (H) (OH-modified paraffin wax).

The toner exhibited a lower $T_{OFFSET}$ presumably due to the use of polypropylene wax exhibiting high heat-absorption and evolution peaks and failing to effective transfer to the fixed toner image surface of the wax at the time of toner melt-fixation. The toner was also liable to cause the winding of the transfer paper about the fixing roller (heating roller).

COMPARATIVE EXAMPLE 9

Comparative Cyan toner (F) and Comparative Cyan developer (F) were prepared and evaluated in the same manner as in Comparative Example 5 except for omitting the 6 wt. parts of di-tert-butylsalicylic acid Al compound (organometallic compound).

The toner was liable to cause high temperature offset and exhibit a lower anti-blocking property presumably due to the absence of an organometallic compound effective for providing ionic crosslinkage at the time of melt-kneading.

COMPARATIVE EXAMPLE 10

Comparative Cyan toner (G) and Comparative Cyan developer (G) were prepared and evaluated in the same manner as in Comparative Example 5 except for increasing the amount of the di-tert-butylsalicylic acid Al compound from 6 wt. parts to 11.5 wt. parts.

The toner resulted in fixed toner images with larger surface unevenness which exhibited lower transparency for OHP use because of random reflection of incident light.

COMPARATIVE EXAMPLES 11 and 12

Comparative Cyan toners (H) and (I) (and Comparative Cyan developers (H) and (I)) were prepared and evaluated in the same manner as in Comparative Example 10 except for using di-tert-butylsalicylic acid Zn compound and 2-hydroxy-6-tert-butylnaphthoic acid Fe compound, respectively, instead of the di-tert-butylsalicylic acid Al compound.

The resultant toners were liable to cause high-temperature offset and exhibited lower anti-blocking property presumably because these organometallic compounds functioning as charge control agents failed to show substantial ionic crosslinkage-forming function.

The properties and performances of the toners (and developers) prepared in the above Examples and Comparative Examples are inclusively shown in Tables 5 and 6, respectively.

TABLE 5

| | | | Toner characteristics | | | | | | | | |
|---|---|---|---|---|---|---|---|---|---|---|---|
| | | | Wax | | | | | Organometallic compound | | | |
| | | Main binder Species | Species | hydroxyl value [mgKOH/g] | acid value [mgKOH/g] | $T_{abs.max}$ [° C.] | $T_{evo.max}$ [° C.] | metal species | content (wt. parts) | Toner Mp | Toner Mw/Mn |
| Example | Toner | | | | | | | | | | |
| 20 | Cyan (17) | Hybrid (5) | Polar (A) | 35 | 5 | 67 | 63 | Al | 6.0 | 7260 | 608 |
| 21 | Cyan (18) | Polyester (4) | Polar (A) | 35 | 5 | 67 | 63 | Al | 6.0 | 6020 | 507 |
| 22 | Cyan (19) | Hybrid (5):Polyester (4) = 45:55 | Polar (A) | 35 | 5 | 67 | 63 | Al | 6.0 | 7050 | 556 |
| 23 | Cyan (20) | Polyester (4):Vinyl (2) = 85:15 | Polar (A) | 35 | 5 | 67 | 63 | Al | 6.0 | 6890 | 587 |
| 24 | Cyan (21) | Hybrid (5):Vinyl (2) = 95:5 | Polar (A) | 35 | 5 | 67 | 63 | Al | 6.0 | 7920 | 620 |
| 25 | Cyan (22) | Polyester (4):Hybrid (5):Vinyl (2) = 60:30:10 | Polar (A) | 35 | 5 | 67 | 63 | Al | 6.0 | 7450 | 615 |
| 26 | Cyan (23) | Hybrid (5) | Polar (I) | 69 | 13 | 66 | 62 | Al | 6.0 | 7150 | 327 |
| 27 | Cyan (24) | Hybrid (5) | Polar (J) | 78 | 17 | 61 | 56 | Al | 6.0 | 7210 | 415 |
| 28 | Cyan (25) | Hybrid (5) | Polar (K) | 21 | 3 | 67 | 63 | Al | 6.0 | 7330 | 476 |
| 29 | Cyan (26) | Hybrid (5) | Polar (L) | 11 | 2 | 67 | 63 | Al | 6.0 | 7410 | 389 |
| 30 | Cyan (27) | Hybrid (5) | Polar (A) | 35 | 5 | 67 | 63 | Al | 2.0 | 6250 | 308 |
| 31 | Cyan (28) | Hybrid (5) | Polar (A) | 35 | 5 | 67 | 63 | Al | 8.0 | 7830 | 890 |
| 32 | Cyan (29) | Hybrid (5) | Polar (A) | 35 | 5 | 67 | 63 | Cr | 6.0 | 7520 | 740 |
| Comp. Ex. | Comp. Toner | | | | | | | | | | |
| 5 | Cyan (B) | Vinyl (2) | Polar (F) | 85 | 23 | 53 | 49 | M | 6.0 | 8067 | 88 |
| 6 | Cyan (C) | Vinyl (2) | Polar (G) | 4 | 1 | 64 | 60 | Al | 6.0 | 7160 | 108 |
| 7 | Cyan (D) | Vinyl (2) | Polar (H) | 108 | 45 | 48 | 44 | Al | 6.0 | 5890 | 42 |
| 8 | Cyan (E) | Vinyl (2) | Polypropylene | — | — | 145 | 140 | Al | 6.0 | 6090 | 44 |
| 9 | Cyan (F) | Vinyl (2) | Polar (A) | 35 | 5 | 67 | 63 | Al | 0.0 | 6890 | 55 |
| 10 | Cyan (G) | Vinyl (2) | Polar (A) | 35 | 5 | 67 | 63 | Al | 11.5 | 14560 | 203 |
| 11 | Cyan (H) | Vinyl (2) | Polar (A) | 35 | 5 | 67 | 63 | Zn | 6.0 | 7890 | 74 |
| 12 | Cyan (I) | Vinyl (2) | Polar (A) | 35 | 5 | 67 | 63 | Fe | 6.0 | 8887 | 33 |

TABLE 6

| | Toner performances | | | | | |
|---|---|---|---|---|---|---|
| | Fixing performances (Fix. speed = 80 mm/sec) | | | Properties | | |
| | $T_{FI}$ (° C.) | $T_{OFFSET}$ (° C.) | $T_{OFFSET} - T_{FI}$ (° C.) | Flowability | Transmittance | Heat resistance |
| Example | | | | | | |
| 20 | 110 | 200 | 90 | A | A | A |
| 21 | 100 | 190 | 90 | A | A | A |
| 22 | 110 | 195 | 85 | A | A | A |
| 23 | 110 | 190 | 80 | A | B | A |
| 24 | 110 | 185 | 75 | A | B | A |
| 25 | 110 | 180 | 70 | A | B | A |
| 26 | 110 | 220 | 110 | A | B | B |
| 27 | 110 | 220 | 110 | A | B | B |
| 28 | 110 | 195 | 85 | A | A | A |
| 29 | 110 | 195 | 85 | A | A | A |
| 30 | 110 | 170 | 60 | B | A | B |
| 31 | 110 | 220 | 110 | A | B | A |
| 32 | 110 | 180 | 70 | B | B | A |
| Comp. Ex. | | | | | | |
| 5 | 110 | 180 | 70 | C | D | D |
| 6 | 110 | 175 | 65 | E | C | C |
| 7 | 110 | 180 | 70 | C | D | E |
| 8 | 130 | 150 | 20 | B | D | B |

TABLE 6-continued

| | Toner performances | | | | | |
|---|---|---|---|---|---|---|
| | Fixing performances (Fix. speed = 80 mm/sec) | | | Properties | | |
| | $T_{FI}$ (° C.) | $T_{OFFSET}$ (° C.) | $T_{OFFSET} - T_{FI}$ (° C.) | Flowability | Transmittance | Heat resistance |
| 9 | 110 | 130 | 20 | E | B | E |
| 10 | 110 | 180 | 70 | B | E | B |
| 11 | 120 | 155 | 35 | D | C | D |
| 12 | 125 | 160 | 35 | D | D | E |

What is claimed is:

1. A toner, comprising; at least a binder resin, a colorant and a wax, wherein the binder resin comprises a resin selected from the group consisting of (a) a polyester resin, (b) a hybrid resin having a polyester unit and a vinyl polymer unit, and (c) a mixture of these resins, and the wax has a structural unit including a polar group and represented by any one of formulae (I)–(IV) or a structure having a polar group and represented by formula (V):

(I)

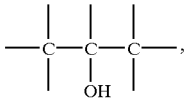

(II)

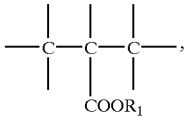

wherein $R_1$ denotes hydrogen or a hydrocarbon group having 1–8 carbon atoms, (III)

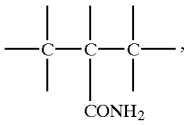

(IV)

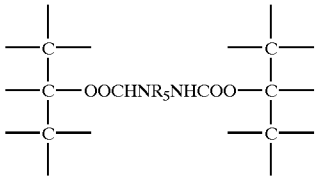

wherein $R_5$ denotes a saturated hydrocarbon group having 2–20 carbon atoms, an unsaturated hydrocarbon group having 2–10 carbon atoms, an aromatic hydrocarbon group, or an alicyclic hydrocarbon group, and (V)

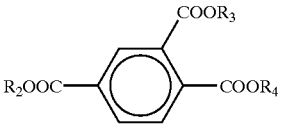

wherein $R_2$, $R_3$ and $R_4$ independently denote hydrogen or a hydrocarbon group having 8–50 carbon atoms with the provision that at least one of $R_2$, $R_3$ and $R_4$ is a hydrocarbon group having 8–50 carbon atoms.

2. The toner according to claim 1, wherein the binder resin further contains a vinyl copolymer.

3. The toner according to claim 1, wherein the binder resin comprises the polyester resin and the hybrid resin.

4. The toner according to claim 1, wherein the binder resin comprises the polyester resin and a vinyl copolymer.

5. The toner according to claim 1, wherein the binder resin comprises the hybrid resin and a vinyl copolymer.

6. The toner according to claim 1, wherein the wax further contains a hydrocarbon wax having no polar group.

7. The toner according to claim 6, wherein the hydrocarbon wax having no polar group exhibits a thermal behavior providing a heat-absorption curve according to differential scanning calorimetry (DSC) showing a maximum heat-absorption peak temperature in a range of 55–90° C. in a temperature range of 30–200° C.

8. The toner according to claim 7, wherein the hydrocarbon wax having no polar group exhibits a thermal behavior providing a heat-absorption curve according to differential scanning calorimetry (DSC) showing a maximum heat-absorption peak temperature in a range of 60–85° C. in a temperature range of 30–200° C.

9. The toner according to claim 6, wherein the hydrocarbon wax having no polar group exhibits a thermal behavior providing a heat-evolution curve according to differential scanning calorimetry (DSC) showing a maximum heat-evolution peak temperature in a range of 45–90° C. in a temperature range of 30–200° C.

10. The toner according to claim 6, wherein the hydrocarbon wax having no polar group exhibits a thermal behavior providing a heat-evolution curve according to differential scanning calorimetry (DSC) showing a maximum heat-evolution peak temperature in a range of 50–85° C. in a temperature range of 30–200° C.

11. The toner according to claim 1, wherein the toner contains a tetrahydrofuran-soluble resin component exhibiting a molecular weight distribution according to GPC (gel permeation chromatography) including a main peak in a molecular weight region of 6000–8000, and a ratio (Mw/Mn) of at least 300 between weight-average molecular weight (Mw) and number-average molecular weight (Mn).

12. The toner according to claim 1, wherein the toner contains a tetrahydrofuran-soluble resin component exhibiting a molecular weight distribution according to GPC (gel permeation chromatography) including a main peak in a molecular weight region of 6000–8000, and a ratio (Mw/Mn) of at least 500 between weight-average molecular weight (Mw) and number-average molecular weight (Mn).

13. The toner according to claim 1, wherein the wax has a structural unit of the formula (I) and has a hydroxyl value of 10–70 mgKOH/g.

14. The toner according to claim 1, wherein the wax has a structural unit of the formula (I) and has an acid value of 1–20 mgKOH/g.

15. The toner according to claim 1, wherein the wax has both a structural unit of the formula (I) and a structural unit of the formula (II).

16. The toner according to claim 15, wherein the wax has an acid value of 1–60 mgKOH/g.

17. The toner according to claim 1, wherein the wax including a polar group exhibits a thermal behavior providing a heat-absorption curve according to differential scanning calorimetry (DSC) showing a maximum heat-absorption peak temperature in a range of 55–90° C. in a temperature range of 30–200° C.

18. The toner according to claim 1, wherein the wax including a polar group exhibits a thermal behavior providing a heat-absorption curve according to differential scanning calorimetry (DSC) showing a maximum heat-absorption peak temperature in a range of 60–85° C. in a temperature range of 30–200° C.

19. The toner according to claim 1, wherein the wax including a polar group exhibits a thermal behavior providing a heat-evolution curve according to differential scanning calorimetry (DSC) showing a maximum heat-evolution peak temperature in a range of 45–90° C. in a temperature range of 30–200° C.

20. The toner according to claim 1, wherein the wax including a polar group exhibits a thermal behavior providing a heat-evolution curve according to differential scanning calorimetry (DSC) showing a maximum heat-evolution peak temperature in a range of 50–85° C. in a temperature range of 30–200° C.

21. The toner according to claim 1, wherein the toner further contains an organometallic compound.

22. The toner according to claim 21, wherein the organometallic compound is a metal compound of an aromatic carboxylic acid derivative selected from aromatic oxycarboxylic acids and aromatic alkoxycarboxylic acids.

23. The toner according to claim 22, wherein the organometallic compound is contained in a proportion of 0.1–10 wt. % of the toner.

24. The toner according to claim 1, wherein the toner further contains an organometallic compound and a hydrocarbon wax having no polar group.

25. The toner according to claim 24, wherein the binder resin further contains a vinyl copolymer.

26. The toner according to claim 24, wherein the binder resin comprises the polyester resin and the hybrid resin.

27. The toner according to claim 24, wherein the binder resin comprises the polyester resin and a vinyl copolymer.

28. The toner according to claim 24, wherein the binder resin comprises the hybrid resin and a vinyl copolymer.

29. The toner according to claim 24, wherein the hydrocarbon wax having no polar group exhibits a thermal behavior providing a heat-absorption curve according to differential scanning calorimetry (DSC) showing a maximum heat-absorption peak temperature in a range of 55–90° C. in a temperature range of 30–200° C.

30. The toner according to claim 24, wherein the hydrocarbon wax having no polar group exhibits a thermal behavior providing a heat-absorption curve according to differential scanning calorimetry (DSC) showing a maximum heat-absorption peak temperature in a range of 60–85° C. in a temperature range of 30–200° C.

31. The toner according to claim 24, wherein the hydrocarbon wax having no polar group exhibits a thermal behavior providing a heat-evolution curve according to differential scanning calorimetry (DSC) showing a maximum heat-evolution peak temperature in a range of 45–90° C. in a temperature range of 30–200° C.

32. The toner according to claim 24, wherein the hydrocarbon wax having no polar group exhibits a thermal behavior providing a heat-evolution curve according to differential scanning calorimetry (DSC) showing a maximum heat-evolution peak temperature in a range of 50–85° C. in a temperature range of 30–200° C.

33. The toner according to claim 24, wherein the toner contains a tetrahydrofuran-soluble resin component exhibiting a molecular weight distribution according to GPC (gel permeation chromatography) including a main peak in a molecular weight region of 6000–8000, and a ratio (Mw/Mn) of at least 300 between weight-average molecular weight (Mw) and number-average molecular weight (Mn).

34. The toner according to claim 24, wherein the toner contains a tetrahydrofuran-soluble resin component exhibiting a molecular weight distribution according to GPC (gel permeation chromatography) including a main peak in a molecular weight region of 6000–8000, and a ratio (Mw/Mn) of at least 500 between weight-average molecular weight (Mw) and number-average molecular weight (Mn).

35. The toner according to claim 26, wherein the wax has a structural unit of the formula (I) and has a hydroxyl value of 10–70 mgKOH/g.

36. The toner according to claim 27, wherein the wax has a structural unit of the formula (I) and has an acid value of 1–20 mgKOH/g.

37. The toner according to claim 24, wherein the wax has both a structural unit of the formula (I) and a structural unit of the formula (II).

38. The toner according to claim 37, wherein the wax has an acid value of 1–60 mgKOH/g.

39. The toner according to claim 24, wherein the wax including a polar group exhibits a thermal behavior providing a heat-absorption curve according to differential scanning calorimetry (DSC) showing a maximum heat-absorption peak temperature in a range of 55–90° C. in a temperature range of 30–200° C.

40. The toner according to claim 24, wherein the wax including a polar group exhibits a thermal behavior providing a heat-absorption curve according to differential scanning calorimetry (DSC) showing a maximum heat-absorption peak temperature in a range of 60–85° C. in a temperature range of 30–200° C.

41. The toner according to claim 24, wherein the wax including a polar group exhibits a thermal behavior providing a heat-evolution curve according to differential scanning calorimetry (DSC) showing a maximum heat-evolution peak temperature in a range of 45–90° C. in a temperature range of 30–200° C.

42. The toner according to claim 24, wherein the wax including a polar group exhibits a thermal behavior providing a heat-evolution curve according to differential scanning calorimetry (DSC) showing a maximum heat-evolution peak temperature in a range of 50–85° C. in a temperature range of 30–200° C.

43. The toner according to claim 24, wherein the organometallic compound is a metal compound of an aromatic carboxylic acid derivative selected from aromatic oxycarboxylic acids and aromatic alkoxycarboxylic acids.

44. The toner according to claim 43, wherein the organometallic compound is contained in a proportion of 0.1–10 wt. % of the toner.

45. The toner according to claim 1, wherein the wax including a polar group has a structural unit of the formula 1, has a hydroxyl value of 5–80 mgKOH/g, and exhibits a thermal behavior providing a heat-absorption curve according to differential scanning calorimetry (DSC) showing a maximum heat-absorption peak temperature in a range of 55–90° C. in a temperature range of 30–200° C.

46. The toner according to claim 45, wherein the wax has an acid value of 1–20 mgKOH/g.

47. The toner according to claim 1, wherein the toner is a color toner.

48. The toner according to claim 24, wherein the toner is a color toner.

49. The toner according to claim 1, wherein the wax including a polar group is contained in an amount of 0.1–10 wt. % of the toner.

50. The toner according to claim 24, wherein the wax having no polar group is contained in an amount of 0.1–10 wt. % of the toner.

51. The toner according to claim 24, wherein the organometallic compound, the wax including a polar group and the hydrocarbon wax having no polar group are each contained in an amount of 0.1–10 wt. % of the toner.

52. An image forming method, comprising:

(A) an image forming cycle including:

a step of forming an electrostatic image on an image bearing member, a step of developing the electrostatic image with a color toner to form a color toner image on the image bearing member, and a step of transferring the color toner image onto a transfer material via or without via an intermediate transfer member, (B) a process of repeating the image forming cycle (A) four times by using first to fourth color toners, respectively, to form superposed first to fourth color toner images on the transfer material, and (C) a step of fixing the superposed first to fourth color toner images on the transfer material under application of heat and pressure to form a fixed full-color image on the transfer material, wherein the first to fourth color toners are selected successively in an arbitrary order from the group consisting of a cyan toner, a magenta toner, a yellow toner and a black toner, each of the cyan, magenta, yellow and black toners comprises at least a binder resin, a wax and a corresponding colorant selected from the group consisting of a cyan colorant, a magenta colorant, a yellow colorant and a black colorant, the binder resin comprises a resin selected from the group consisting of (a) a polyester resin, (b) a hybrid resin having a polyester unit and a vinyl polymer unit, and (c) a mixture of these resins, and the wax has a structural unit including a polar group and represented by any one of formulae (I)–(IV) or a structure having a polar group and represented by formula (V):

(I)

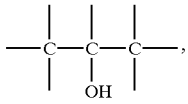

(II)

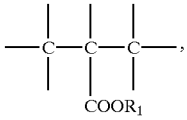

wherein $R_1$ denotes hydrogen or a hydrocarbon group having 1–8 carbon atoms, (III)

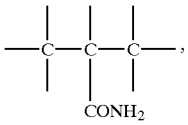

(IV)

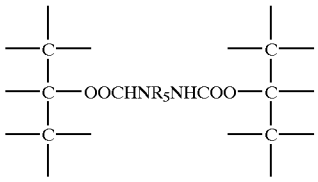

wherein $R_5$ denotes a saturated hydrocarbon group having 2–20 carbon atoms, an unsaturated hydrocarbon group having 2–10 carbon atoms, an aromatic hydrocarbon group, or an alicyclic hydrocarbon group, and (V)

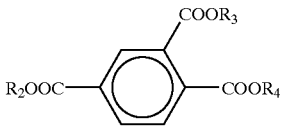

wherein $R_2$, $R_3$ and $R_4$ independently denote hydrogen or a hydrocarbon group having 8–50 carbon atoms with the proviso that at least one of $R_2$, $R_3$ and $R_4$ is a hydrocarbon group having 8–50 carbon atoms.

53. The image forming method according to claim 52, wherein in the process (B), the image forming cycle (A) is repeated four times by using a single image bearing member.

54. The image forming method according to claim 52, wherein in the process (B), the image forming cycle (A) is repeated four times by using first to four image bearing members, respectively.

55. The image forming method according to claim 52, wherein the toner images are fixed under application of heat and pressure and under application of silicone oil supplied from a fixing member to a fixing surface at a rate of at most $1\times10^{-7}$ g/cm$^2$.

56. The image forming method according to claim 52, wherein the toner images are fixed under application of heat and pressure and under no application of offset-prevention oil from a fixing member to a fixing surface.

57. An image forming method comprising:

(A) an image forming cycle including:

a step of forming an electrostatic image on an image bearing member, a step of developing the electrostatic image with a color toner to form a color toner image on the image bearing member, and a step of transferring the color toner image onto a transfer material via or without via an intermediate transfer member, (B) a process of repeating the image forming cycle (A) four times by using first to fourth color toners, respectively, to form superposed first to fourth color toner images on the transfer material, and (C) a step of fixing the superposed first to fourth color toner images on the transfer material under application of heat and pressure to form a fixed full-color image on the transfer material, wherein the first to fourth color toners are selected successively in an arbitrary order from the group consisting of a cyan toner, a magenta toner, a yellow toner and a black toner, each of the cyan, magenta, yellow and black toners comprises at least a binder resin, a wax and a corresponding colorant selected from the group consisting of a cyan colorant, a magenta colorant, a yellow colorant and a black colorant, the binder resin comprises a resin selected from the group consisting of (a) a polyester resin, (b) a hybrid resin having a polyester unit and a vinyl polymer unit, and (c) a mixture of these resins, and the wax has a structural unit including a polar group and represented by any one of formulae (I)–(IV) or a structure having a polar group and represented by formula (V):

(I)

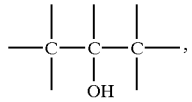

(II)

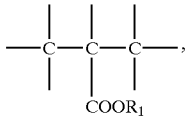

wherein $R_1$ denotes hydrogen or a hydrocarbon group having 1–8 carbon atoms, (III)

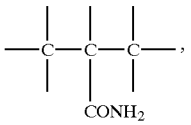

(IV)

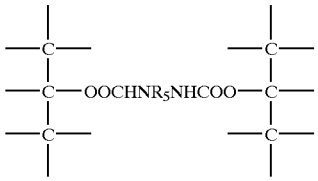

wherein $R_5$ denotes a saturated hydrocarbon group having 2–20 carbon atoms, an unsaturated hydrocarbon group having 2–10 carbon atoms, an aromatic hydrocarbon group, or an alicyclic hydrocarbon group, and (V)

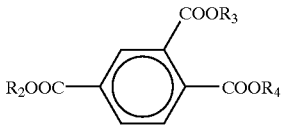

wherein $R_2$, $R_3$ and $R_4$ independently denote hydrogen or a hydrocarbon group having 8–50 carbon atoms with the proviso that at least one of $R_2$, $R_3$ and $R_4$ is a hydrocarbon group having 8–50 carbon atoms, and wherein at least one of the first to fourth color toners is a toner according to any one of claims 2–51.

* * * * *

UNITED STATES PATENT AND TRADEMARK OFFICE

CERTIFICATE OF CORRECTION

PATENT NO. : 6,528,222 B2
DATED : March 4, 2003
INVENTOR(S) : Takaaki Kohtaki et al.

It is certified that error appears in the above-identified patent and that said Letters Patent is hereby corrected as shown below:

Title page,
Item [56], FOREIGN PATENT DOCUMENTS,
"3304" should read -- 52-3304 --;
"3305" should read -- 52-3305 --;
"52574" should read -- 57-52574 --;
"185660" should read -- 1-185660 --;
"185661" should read -- 1-185661 --;
"185662" should read -- 1-185662 --;
"185663" should read -- 1-185663 --;
"238672" should read -- 1-238672 --;
"107467" should read -- 4-107467 --;
"149559" should read -- 4-149559 --;
"301853" should read -- 4-301853 --;
"061238" should read -- 5-061238 --;
"50368" should read -- 8-50368 --; and
"314300" should read -- 8-314300 --.

Column 6,
Line 16, "barboxyl groups," should read -- carboxyl groups, --; and
Line 18, "phthalic ac id," should read -- phthalic acid, --.

Column 7,
Line 36, "hydroxy-1-methylbutyl)stryrene," should read -- hydroxy-1-methylbutyl)-styrene, --.

Column 9,
Line 19, "and hA" should read -- and --.

Column 11,
Line 43, "formul a" should read -- formula --.

Column 17,
Line 18, "1as" should read -- 1 as --.

Column 18,
Line 8, "In" should be deleted.

Column 19,
Line 61, "16 mm-dia" should read -- 16 mm-dia. --.

UNITED STATES PATENT AND TRADEMARK OFFICE

CERTIFICATE OF CORRECTION

PATENT NO. : 6,528,222 B2
DATED : March 4, 2003
INVENTOR(S) : Takaaki Kohtaki et al.

It is certified that error appears in the above-identified patent and that said Letters Patent is hereby corrected as shown below:

Column 21,
Line 24, "50-200 vl" should read -- 50-200 µl --; and
Line 41, "of 103" should read -- of $10^3$ --.

Column 23
Lines 25 and 28, "a-methylstyrene" should read -- α-methylstyrene --;
Line 31, "a-methylstyrene" should read -- α-methylstyrene -- and "Production" should read -- ¶ Production --.

Column 24,
Line 23, "Production Production" should read -- Production --.

Column 25,

Line 17, "$-\!\left(\!CH_2\!\right)\!-$" should read -- $-\!\left(\!CH_2\!\right)_{23}\!-$ --;

Line 47, "war:" should read -- wax: --; and
Line 49, "acis" should read -- acid --.

Column 26,
Line 16, "-thereby" should read -- thereby --; and
Line 22, "0.7 mg /cm" should read -- 0.7 mg/$cm^2$ --.

Column 27,
Line 45, "blockinQ" should read -- blocking --.

Column 31,
Line 43, " 2-ethylhesyl" should read -- 2-ethylhexyl --;
Line 45, "dituiayl" should read -- dicumyl --;
Line 46, "cf" should read -- of --;
Line 47, "polyoxypropyl" should read -- polyoxypropylene -- and "4-hydrosy-phenyl" should read -- 4-hydroxyphenyl --;
Line 48, "polygxyethylane" should read -- polyoxyethylene --;
Line 50, "sucoinic" should read -- succinic -- and "dihotyltin" should read -- dibutyltin --;
Line 54, "Interior" should read -- interior --;
Line 55, "tire" should read -- the --;
Line 56, "140° C." should read -- 140° C, --;
Line 58, "eras" should read -- was --;
Line 59, "Then" should read -- Then, --;
Line 60, "Hyhrid" should read -- Hybrid --;

UNITED STATES PATENT AND TRADEMARK OFFICE

CERTIFICATE OF CORRECTION

PATENT NO. : 6,528,222 B2
DATED : March 4, 2003
INVENTOR(S) : Takaaki Kohtaki et al.

It is certified that error appears in the above-identified patent and that said Letters Patent is hereby corrected as shown below:

Column 31 (cont'd),
Line 64, "Polvester" should read -- Polyester --; and
Line 65, "polyaxypropyhene" should read -- polyoxypropylene --.

Column 33,
Line 19, "acis" should read -- acid --.

Column 39,
Line 44, "provision" should read -- proviso --.

Signed and Sealed this

Thirteenth Day of April, 2004

JON W. DUDAS
*Acting Director of the United States Patent and Trademark Office*